US011452363B1

(12) United States Patent
Feterman

(10) Patent No.: US 11,452,363 B1
(45) Date of Patent: Sep. 27, 2022

(54) TRANSFORMABLE AND WEARABLE UTILITY ARTICLE

(71) Applicant: Gerardo Feterman, Bay Harbor Islands, FL (US)

(72) Inventor: Gerardo Feterman, Bay Harbor Islands, FL (US)

( * ) Notice: Subject to any disclaimer, the term of this patent is extended or adjusted under 35 U.S.C. 154(b) by 0 days.

(21) Appl. No.: 16/663,008

(22) Filed: Oct. 24, 2019

Related U.S. Application Data

(63) Continuation-in-part of application No. 15/367,299, filed on Dec. 2, 2016, now Pat. No. 10,455,873.

(51) Int. Cl.

| | |
|---|---|
| ***A45F 4/12*** | (2006.01) |
| ***A41D 15/04*** | (2006.01) |
| ***A45C 9/00*** | (2006.01) |
| ***A45C 3/06*** | (2006.01) |

(52) U.S. Cl.
CPC ..... *A45F 4/12* (2013.01); *A41D 15/04* (2013.01); *A45C 3/06* (2013.01); *A45C 9/00* (2013.01)

(58) Field of Classification Search
CPC ..... A45F 4/12; A45F 2200/0541; A45F 4/02; A45F 2004/023; A45F 3/04; A45F 3/02; A41D 15/04; A41D 2400/422; A45C 3/06; A45C 9/00
USPC ..... 224/153, 612
See application file for complete search history.

(56) References Cited

U.S. PATENT DOCUMENTS

| | | | | | |
|---|---|---|---|---|---|
| 294,622 | A * | 3/1884 | Honinger | A45F 3/02 | 224/608 |
| 1,512,228 | A * | 10/1924 | Mannocci | B65D 33/12 | 383/18 |
| 4,395,067 | A * | 7/1983 | Robin | B66C 1/18 | 294/74 |
| 4,475,251 | A * | 10/1984 | Hopkins | A45C 9/00 | 2/85 |
| 4,593,841 | A * | 6/1986 | Lange | A45C 9/00 | 224/153 |
| 4,862,520 | A * | 9/1989 | Gazzola | A41D 15/04 | 2/85 |
| 5,119,979 | A * | 6/1992 | Kallman | G02C 3/04 | 2/271 |
| 5,370,113 | A * | 12/1994 | Parsons | A41D 15/04 | 128/202.13 |
| 5,577,652 | A * | 11/1996 | Cooper | A45F 3/02 | 224/153 |
| 5,903,928 | A * | 5/1999 | Hyung-Seob | A41D 27/00 | 2/244 |
| 5,927,581 | A * | 7/1999 | Reddy | A45F 3/02 | 224/153 |
| 10,165,837 | B2 * | 1/2019 | Busam | A45C 3/02 | |
| 2004/0200040 | A1 * | 10/2004 | Frassanito | A45F 5/02 | 24/3.3 |

(Continued)

*Primary Examiner* — Adam J Waggenspack
(74) *Attorney, Agent, or Firm* — John Rizvi; John Rizvi, P.A.—The Patent Professor®

(57) ABSTRACT

A wearable article that is transformable between a garment configuration and a bag configuration. A writing instrument holder and an eyewear holder may be included to add utility to the article. The bag configuration has two forms: a handbag form and a backpack form depending on the number of straps and their selected attachment points. Handles of the bag configuration are concealable and may have a thru-design for adding strength to the bag configuration.

18 Claims, 28 Drawing Sheets

(56) References Cited

U.S. PATENT DOCUMENTS

| | | | | |
|---|---|---|---|---|
| 2004/0262358 | A1* | 12/2004 | Meyer | A45F 3/08 224/628 |
| 2005/0039260 | A1* | 2/2005 | Tyler | A47G 9/062 5/417 |
| 2006/0137950 | A1* | 6/2006 | Nassanian | A45C 7/0063 190/119 |
| 2013/0212770 | A1* | 8/2013 | Lettieri | A45C 3/00 2/84 |
| 2019/0269229 | A1* | 9/2019 | Rosenblum | A47G 9/0223 |
| 2019/0328092 | A1* | 10/2019 | Gomez-Morillo | A45C 5/02 |

* cited by examiner

TRANSFORMABLE AND WEARABLE UTILITY ARTICLE

CROSS REFERENCE TO RELATED APPLICATIONS

This U.S. non-provisional patent application is a continuation-in-part of co-pending U.S. non-provisional patent application Ser. No. 15/367,299, filed on Dec. 2, 2016, incorporated-by-reference herein in its entirety.

FIELD OF THE INVENTION

The present invention relates generally to convertible apparel and more particularly to a wearable article that is convertible to a bag configuration.

BACKGROUND OF THE INVENTION

It is common for individuals to wear various types of apparel such as jackets, shirts, or robes. For example, apparel can keep a user warm while serving as a fashion statement. Sometimes apparel can have other functions. For example, a bathrobe is commonly made of a water-absorbent material to help a user dry off after a bath or shower. As another example, some jackets are made from water resistant material to protect a user from rain.

A bag is a common item that is configured to hold items and typically has one or more handles, allowing the device to be suspended from one's grip. Sometimes bags have straps that allow a user to wear a bag on their torso. Backpacks have two straps that go over opposite shoulders, while purses and handbags typically have one strap that could be slung over one's shoulder.

Minimalism is becoming more and more common as individuals are more conscious of the number of items they own. Convertible items are gaining in popularity because they have multiple purposes, which could save space and money. For example, scarfs exist that are convertible into a facemask and headband. As another example, multi-purpose tools are common that include a plurality of different apparatuses such as screw drivers, scissors, files, and blades in one unit.

Minimalists would appreciate the ability to convert a garment into a bag, and vice-versa. But, the convertible garments currently available are deficient in various aspects, such as being structurally weak, lacking accessory holders, and lacking the ability to choose different strap and handle arrangements.

Therefore, there exists a need for a convertible bag-garment that improves on currently available systems.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

Disclosed is a wearable article that is convertible between a garment configuration and a bag configuration, the article comprising:

a carrying arrangement for carrying the bag configuration.

In another aspect, the carrying arrangement includes two handles that are oppositely located such that when the garment is folded along a waist line into the bag configuration, the handles meet such that the handles may be used to carry the bag configuration.

In another aspect, the handles are each located at end portions of an inner strip, the inner strip passing through the garment.

In another aspect, the handles are selectively concealable behind a pocket, and exposable through the pocket for use.

In another aspect, the carrying configuration includes two attachment points on the garment configuration, such that the attachment points can each be connected to opposite ends of a strap, allowing the bag configuration to be carried by the strap.

In another aspect, the attachment points are at a waist of the garment configuration, such that the strap attaches to the attachment points while being threaded through a loop of the article, allowing the bag configuration to be carried as a backpack.

In another aspect, the strap is threaded through both handles while being attached to the attachment points at the waist.

In another aspect, the attachment points are on shoulders of the garment configuration such that when the strap is attached to the shoulders, the bag configuration is carriable as a handbag.

In another aspect, the article includes a writing instrument holder.

In another aspect, the article includes an eyewear holder.

In another aspect, in the garment configuration, the article is a robe.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
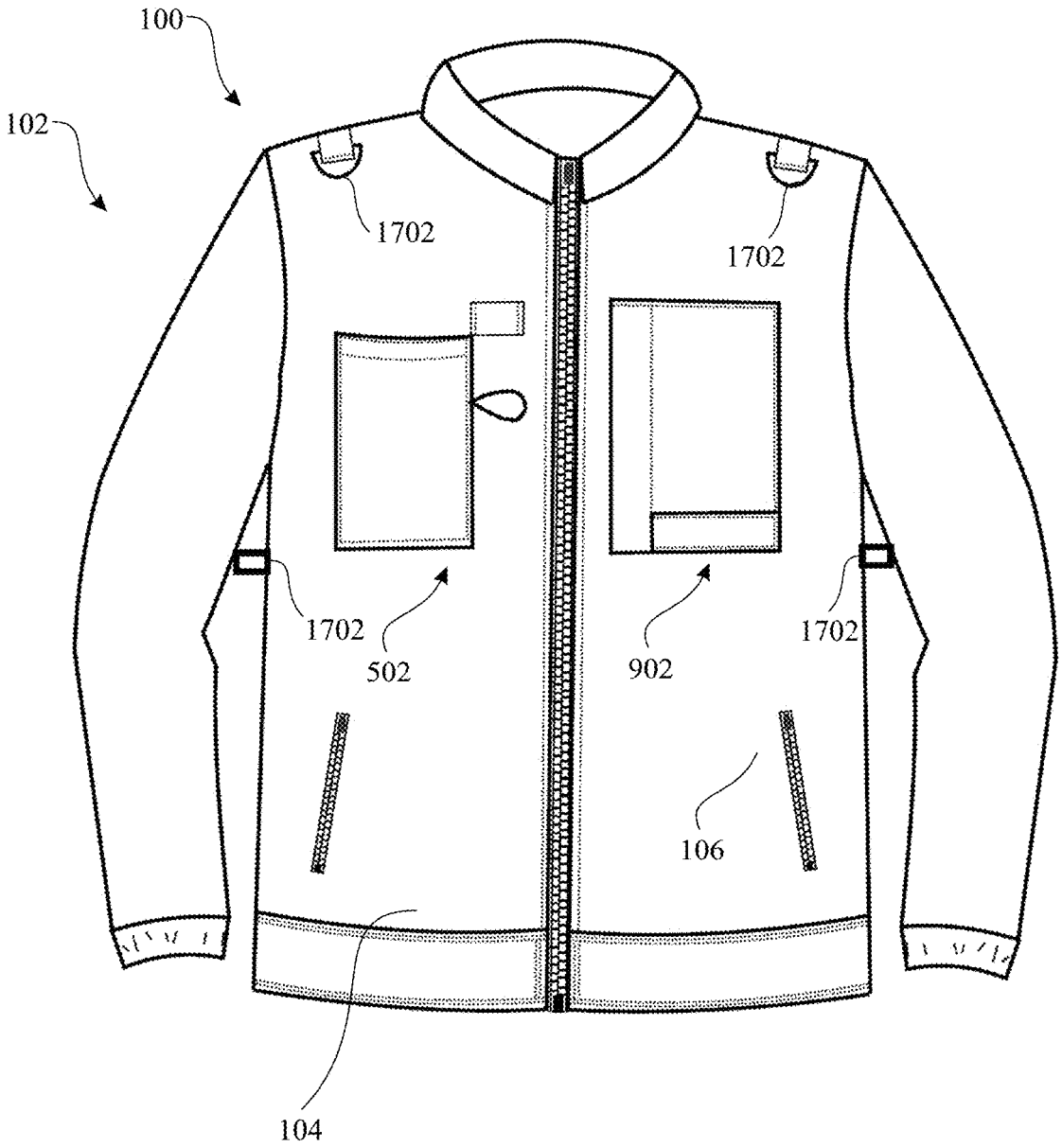
FIG. 1 presents a front view of a wearable article in a garment configuration, in accordance with aspects of the present disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As shown throughout the figures, disclosed is a wearable article 100 that is convertible or transformable between a garment configuration 102 and a bag configuration 1202. For example, garment configurations are shown in FIGS. 1-3, 14, and 17, and bag configurations are shown in FIGS. 12-13, 15-16, 18, 26, and 28. In the garment configuration 102, the article may be a robe or any appropriate garment.

Figure 13:
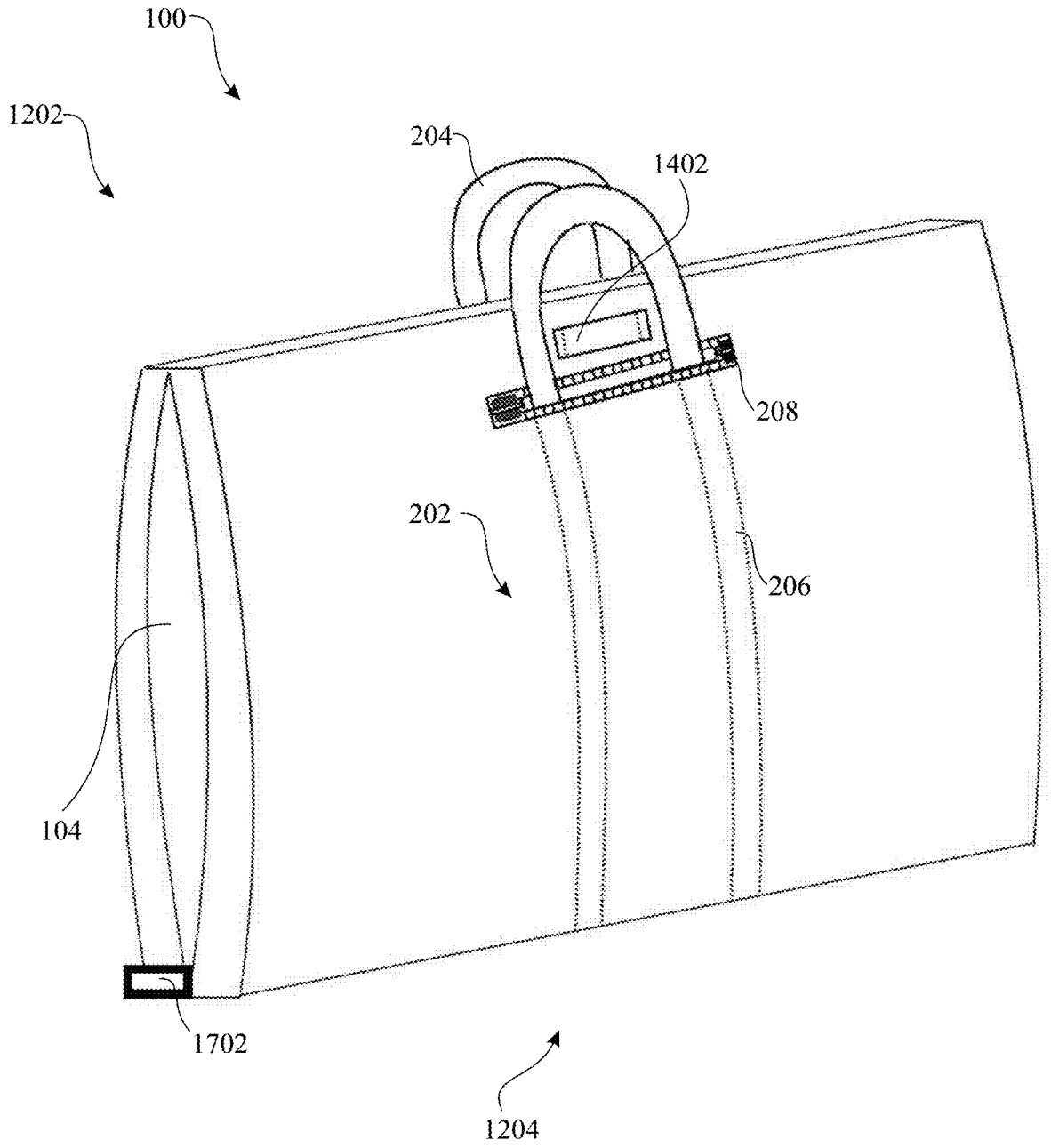
FIG. 13 shows a bag configuration where the handles are exposed, the inner strip shown in dashed line, in accordance with aspects of the present disclosure.

The article 100 may include a carrying arrangement 202 for carrying the bag configuration 1202. The carrying arrangement 202 includes two handles 204 that are oppositely located such that when the garment 102 is folded along a waist line into the bag configuration 1202, the handles 204 meet such that the handles 204 may be used to carry the bag configuration 1202 (FIG. 13). In other words, one handle may be located on an upper part of the garment configuration, above the waist, and near the collar, and a second handle may be located on an opposite lower part of the garment with respect to the waistline.

Figure 2:
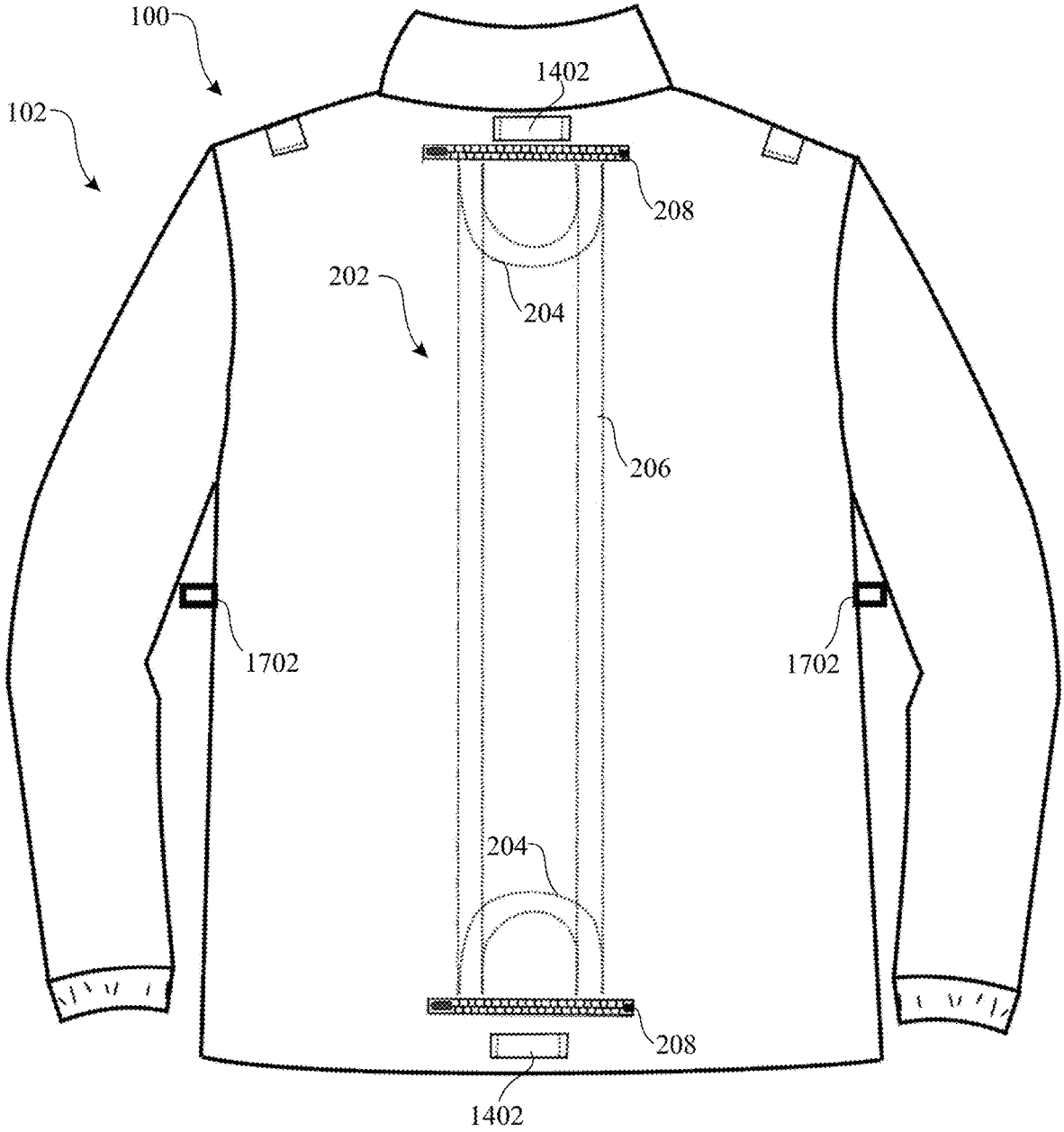
FIG. 2 presents a back view thereof, where handles are shown concealed, and in dashed line a subsurface strip between the handles, in accordance with aspects of the present disclosure.
Figure 3:
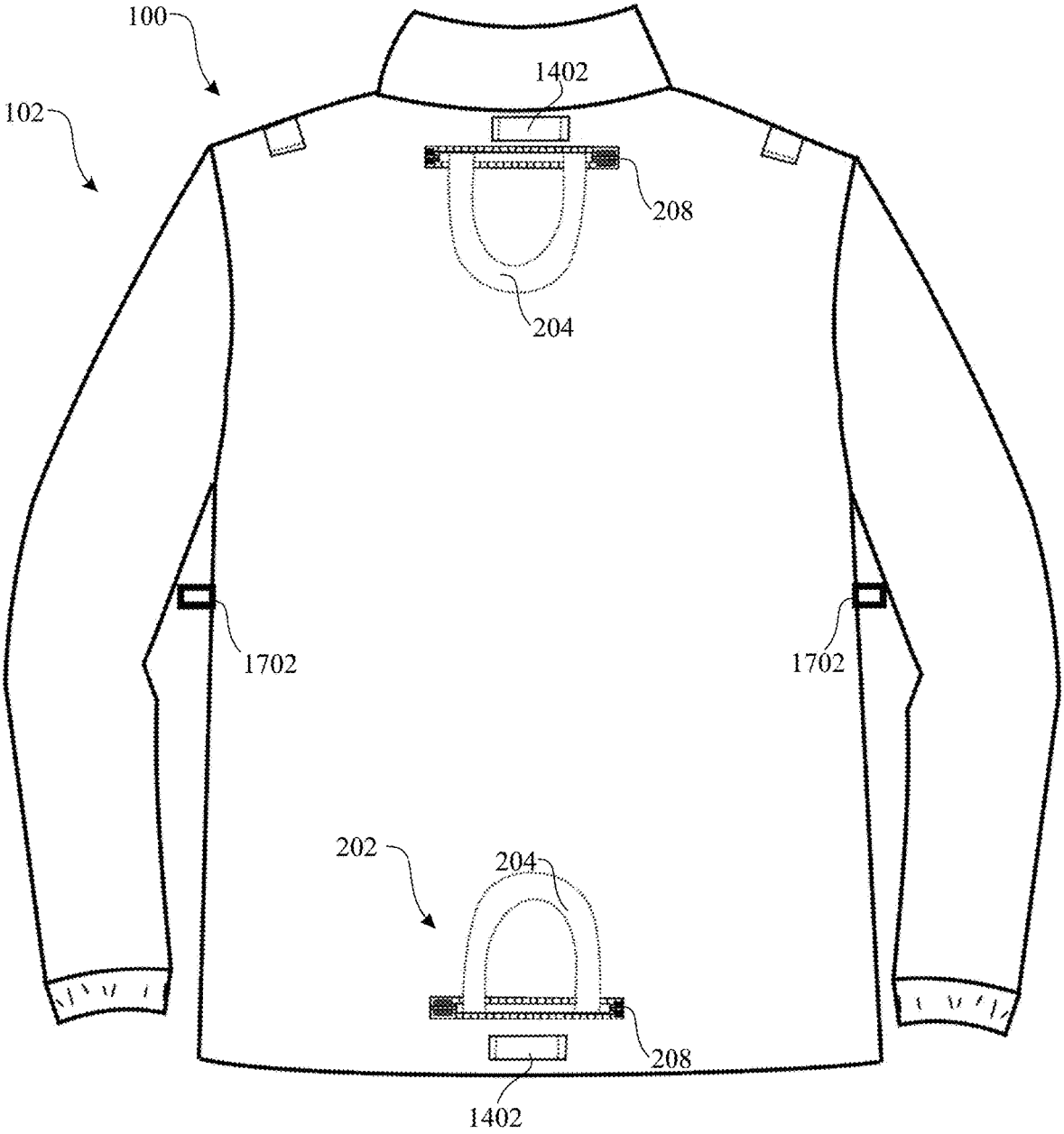
FIG. 3 presents a back view of the article, where the handles are exposed, in accordance with aspects of the present disclosure.

As shown in FIG. 2, the handles 204 may be each located at or connected to end portions of an inner strip 206, the inner strip 206 passing through the garment 102 vertically. As shown in FIG. 2, the handles 204 are each located on a back side of the garment and accessible through an outer surface pocket of the back side. The handles 204 may be selectively concealable behind a pocket 208 (e.g. via a zipper) (FIG. 12 or FIG. 2), and exposable through the pocket 208 for use (FIGS. 3 and 13).

The carrying arrangement 202 may include two or more attachment points 1702 (FIG. 17 and FIG. 23) on the garment configuration 102, such that the attachment points 1702 can each be connected to opposite ends of a strap 2602 (FIGS. 18 and 23), allowing the bag configuration 1202 to be carried by the strap 2602. The attachment points 1702 and number of straps selected determines whether the bag configuration will be of the handbag variety or backpack variety.

Figure 26:
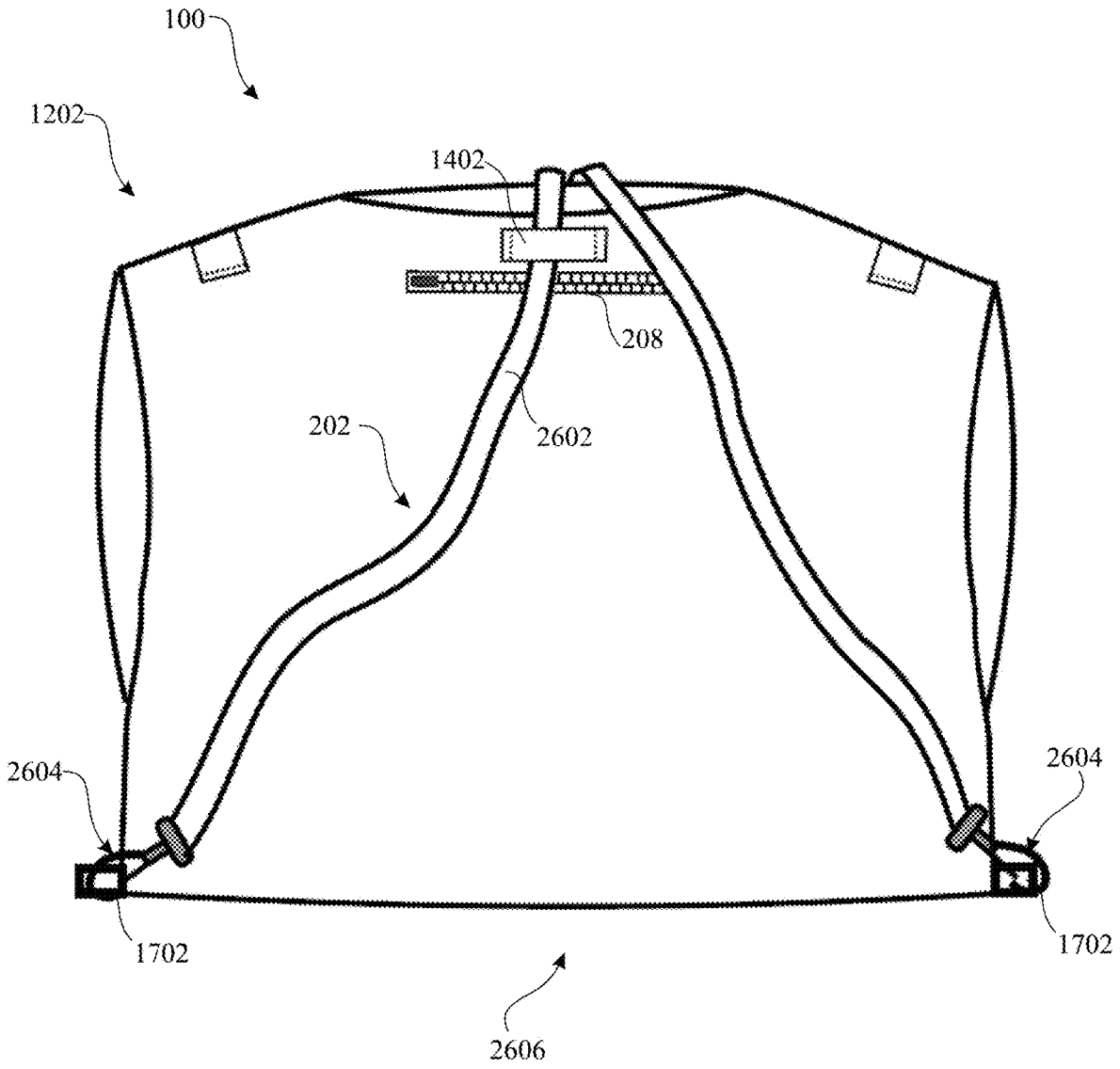
FIG. 26 shows a second strap having been attached to form two shoulder straps for the bag configuration, forming a backpack form, in accordance with aspects of the present disclosure.
Figure 27:
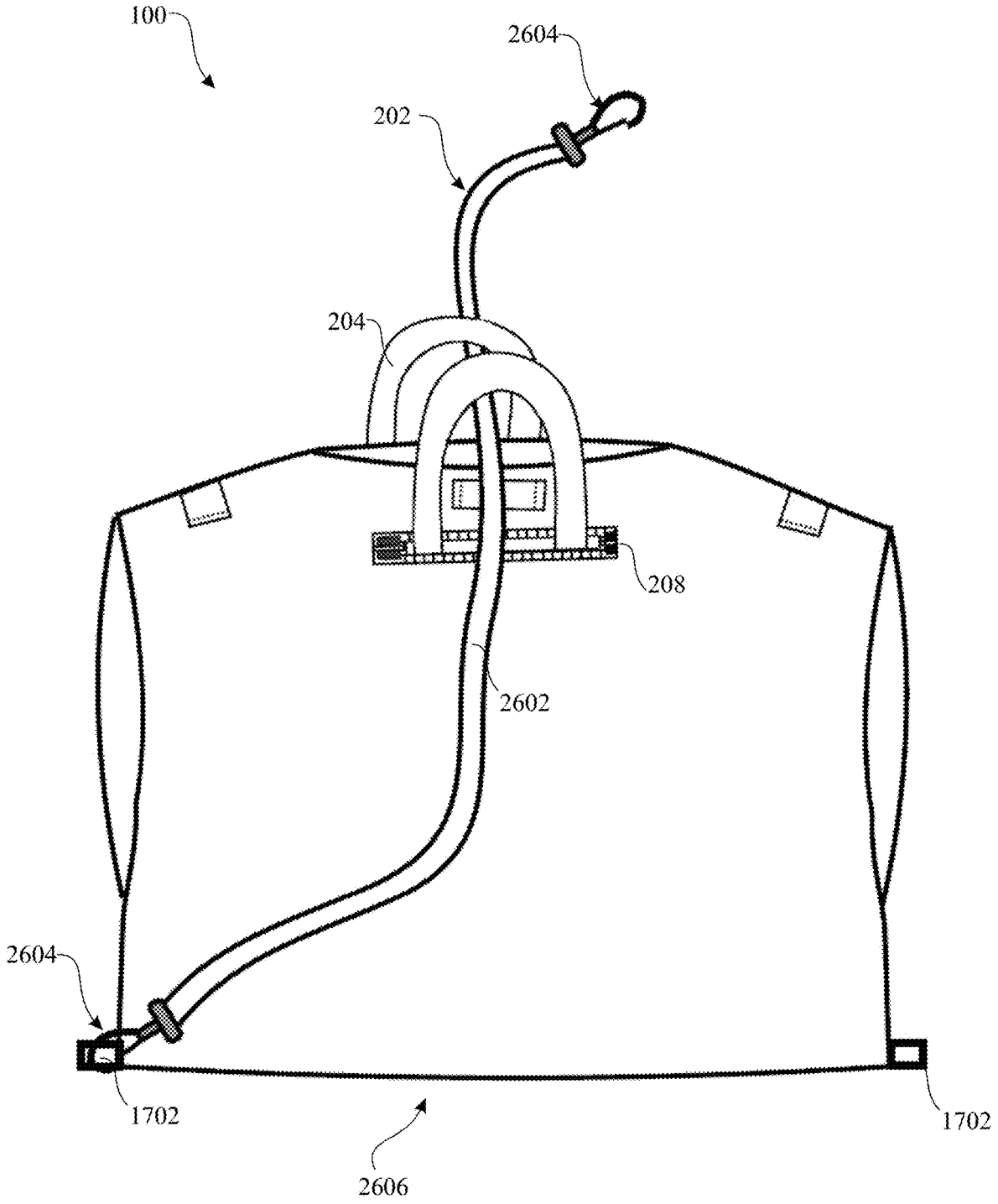
FIGS. 27 and 28 show another method of forming the backpack configuration by threading the strap through exposed handles, in accordance with aspects of the present disclosure.
Figure 28:
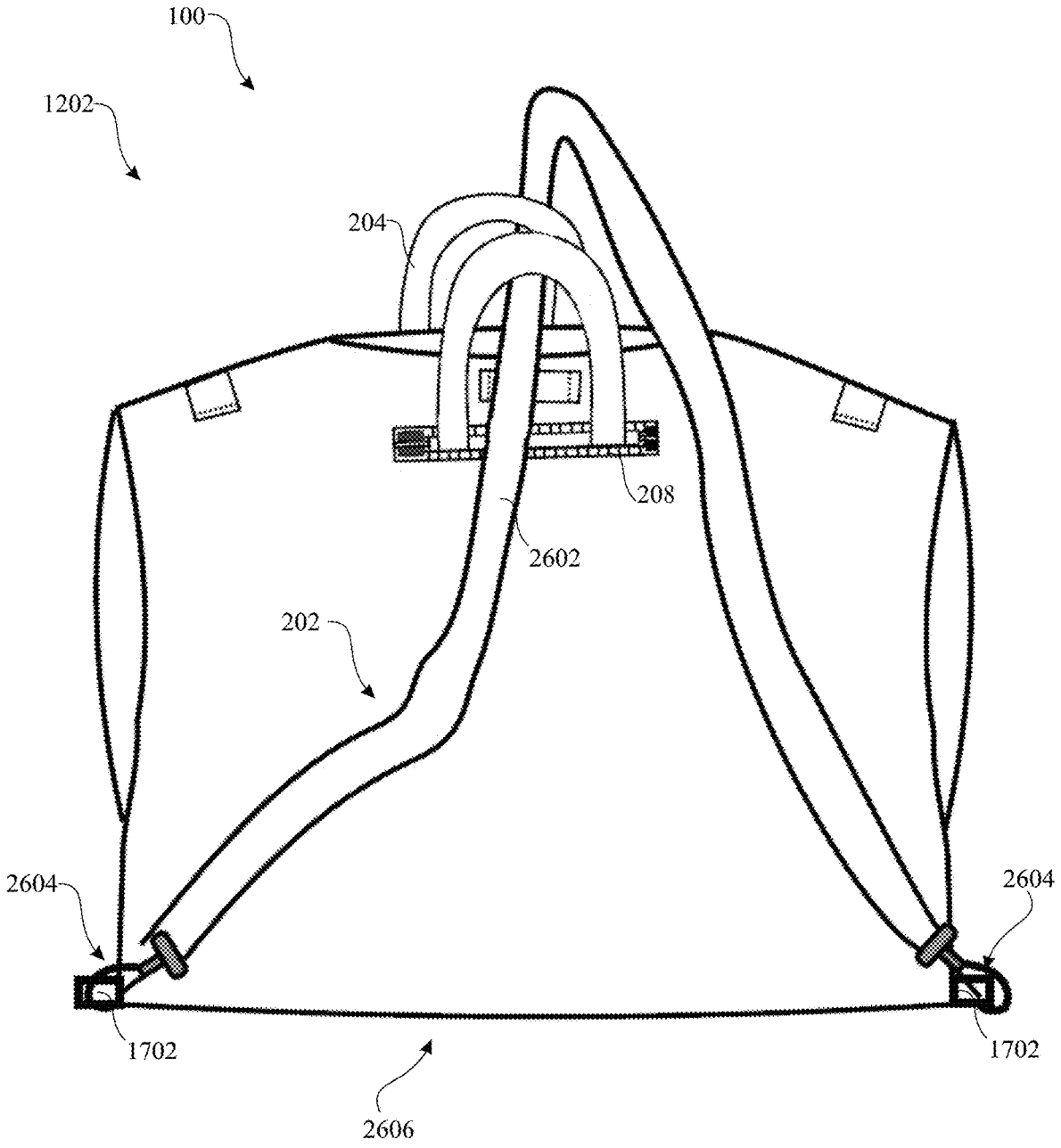

The attachment points 1702 may be located at a waist of the garment configuration 102 (FIG. 14), such that the strap 2602 attaches to the attachment points 1702 while being threaded through an upper loop 1402 of the article 100, allowing the bag configuration 1202 to be carried as a backpack 2606 (FIGS. 26 and 28). As shown in FIG. 28, the strap 2602 may be threaded through both handles 204 while being attached to the attachment points 1702 at the waist. More particularly, to form the backpack, one strap may pass through a loop on a first side of the article in the bag configuration and through a loop on an opposite side of the article while being attached an attachment point. Likewise, a second strap may connect in the same way to an opposite attachment point to cause the straps to have a "V" arrangement for use as a backpack.

Figure 17:
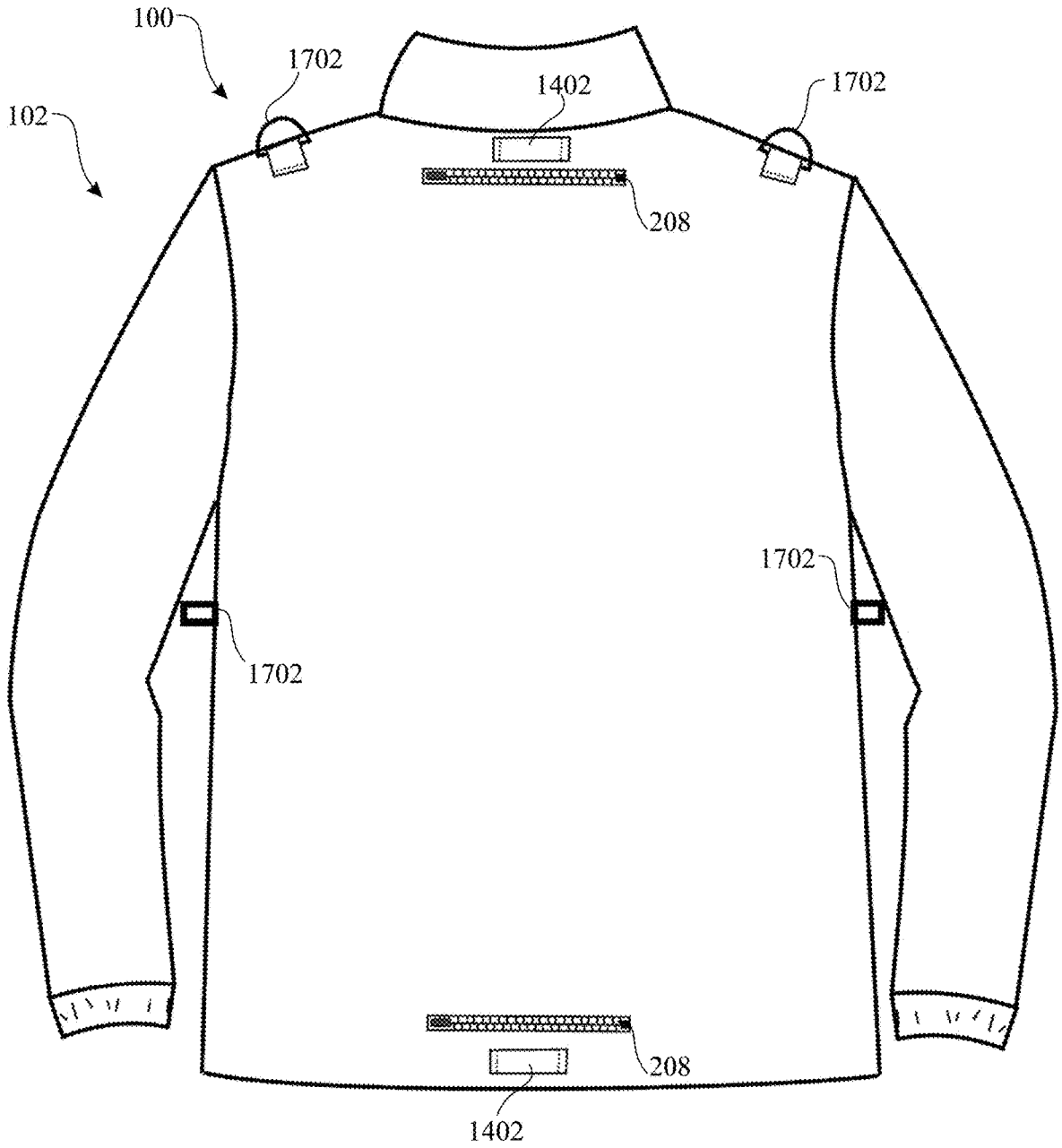
FIG. 17 shows a back view of the garment configuration having shoulder loops that receive straps and allow a user to carry the bag configuration as a handbag, in accordance with aspects of the present disclosure.
Figure 18:
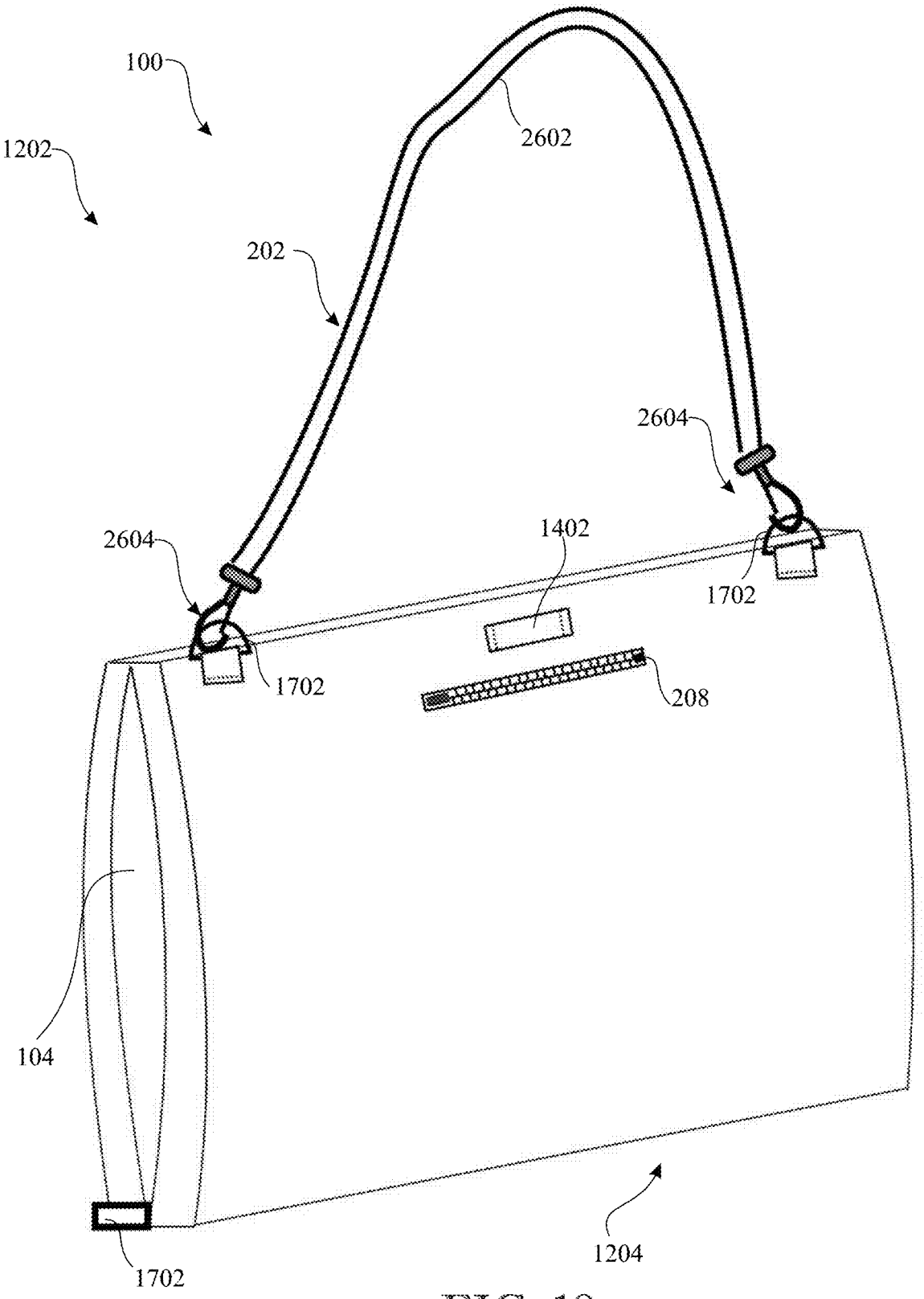
FIG. 18 shows the bag configuration having received straps such that the bag configuration can be used as a handbag, in accordance with aspects of the present disclosure.
Figure 19:
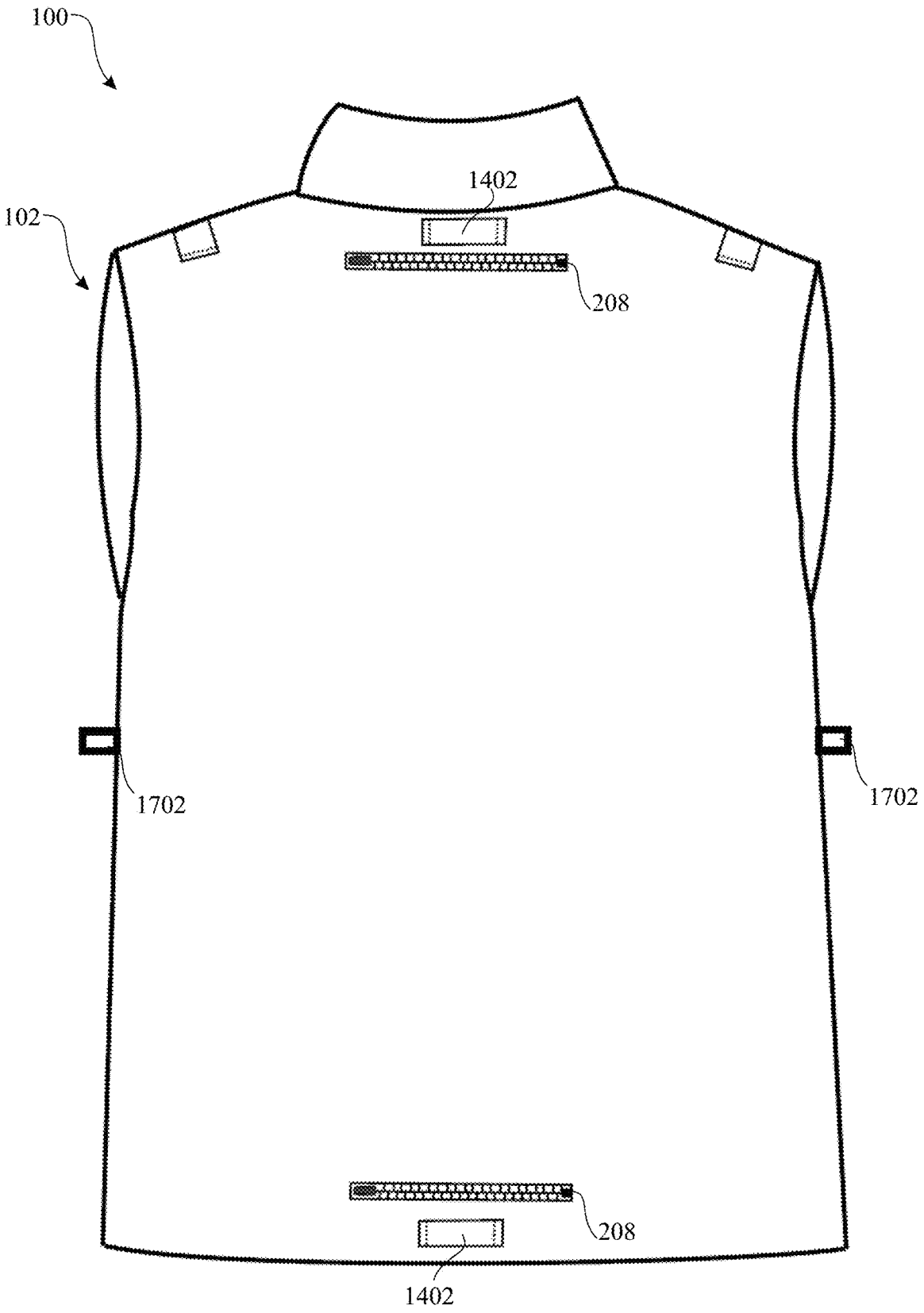
FIG. 19 shows a first step in converting the garment configuration to the bag configuration, where sleeves are folded inward, in accordance with aspects of the present disclosure.

The attachment points 1702 may be on shoulders of the garment configuration 102 such that when the strap 2602 is attached to the shoulders, the bag configuration 1202 is carriable as a handbag 1204 (FIGS. 17 and 18). For example, a pair of attachment points 1702 may be located at a top of the garment configuration and another pair at a bottom of the garment configuration, allowing a strap to hook into matching pairs when the garment configuration is folded along the waistline to form a handbag arrangement.

Figure 9:
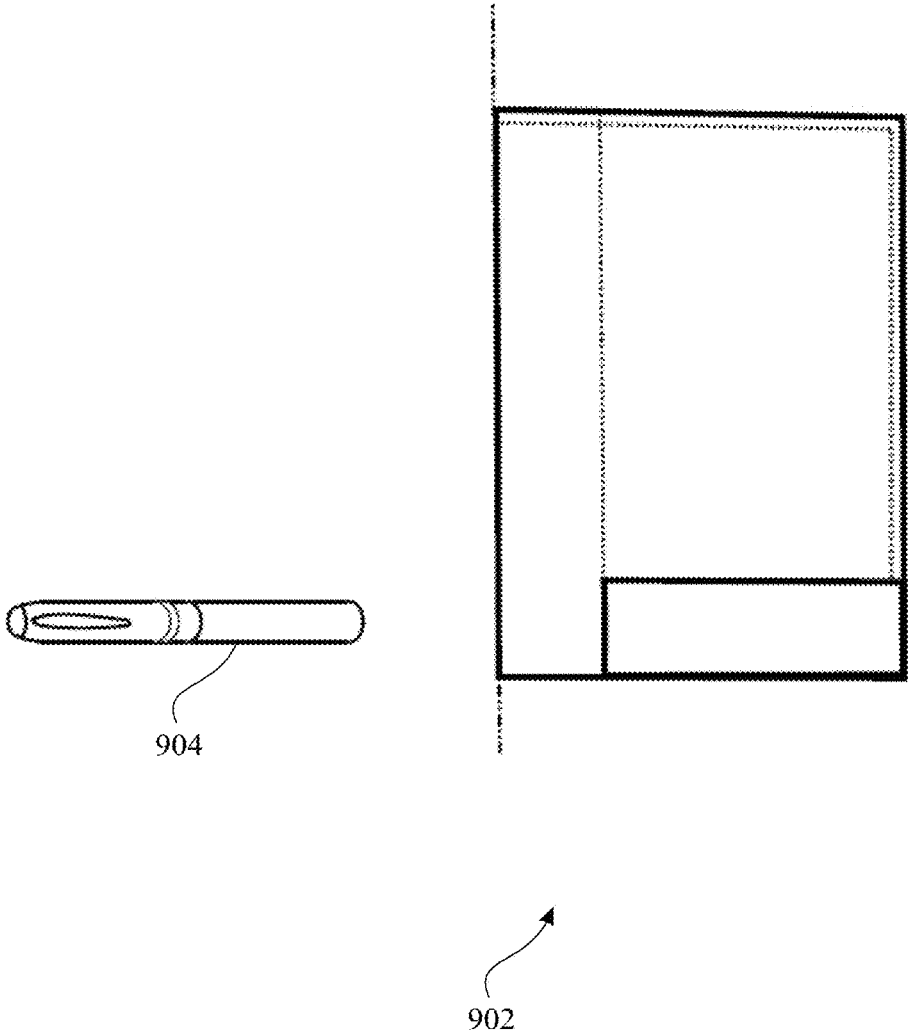
FIGS. 9-11 show a sequence of use of a writing instrument holder, in accordance with aspects of the present disclosure.
Figure 10:
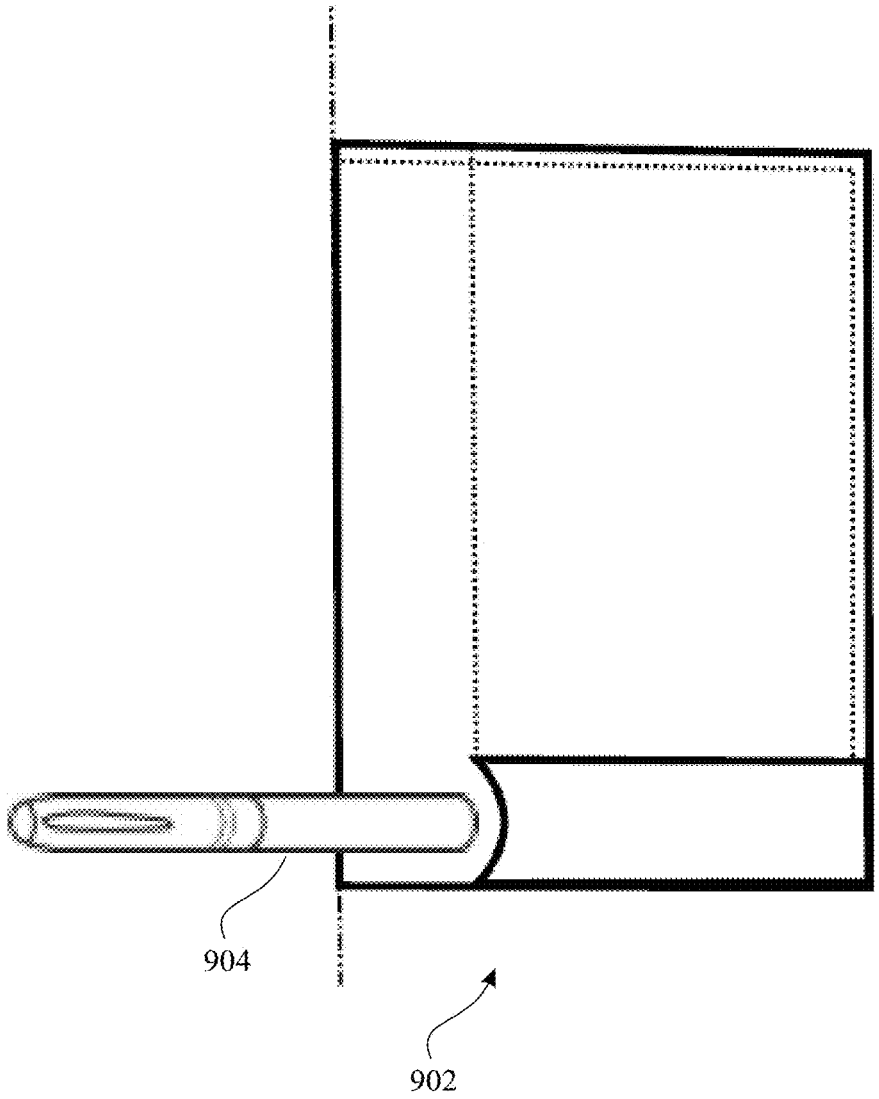
Figure 11:
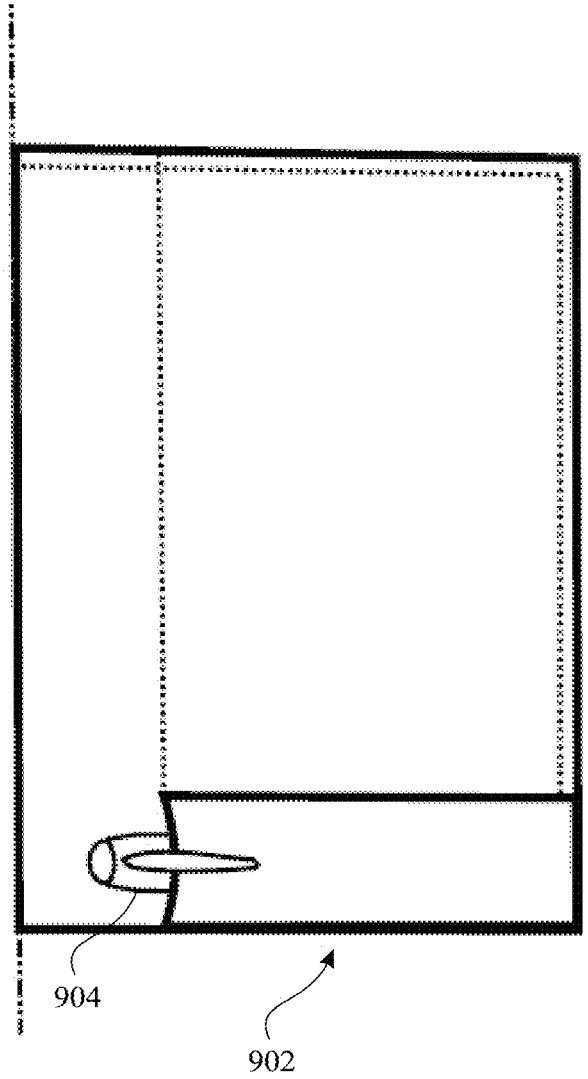
Figure 12:
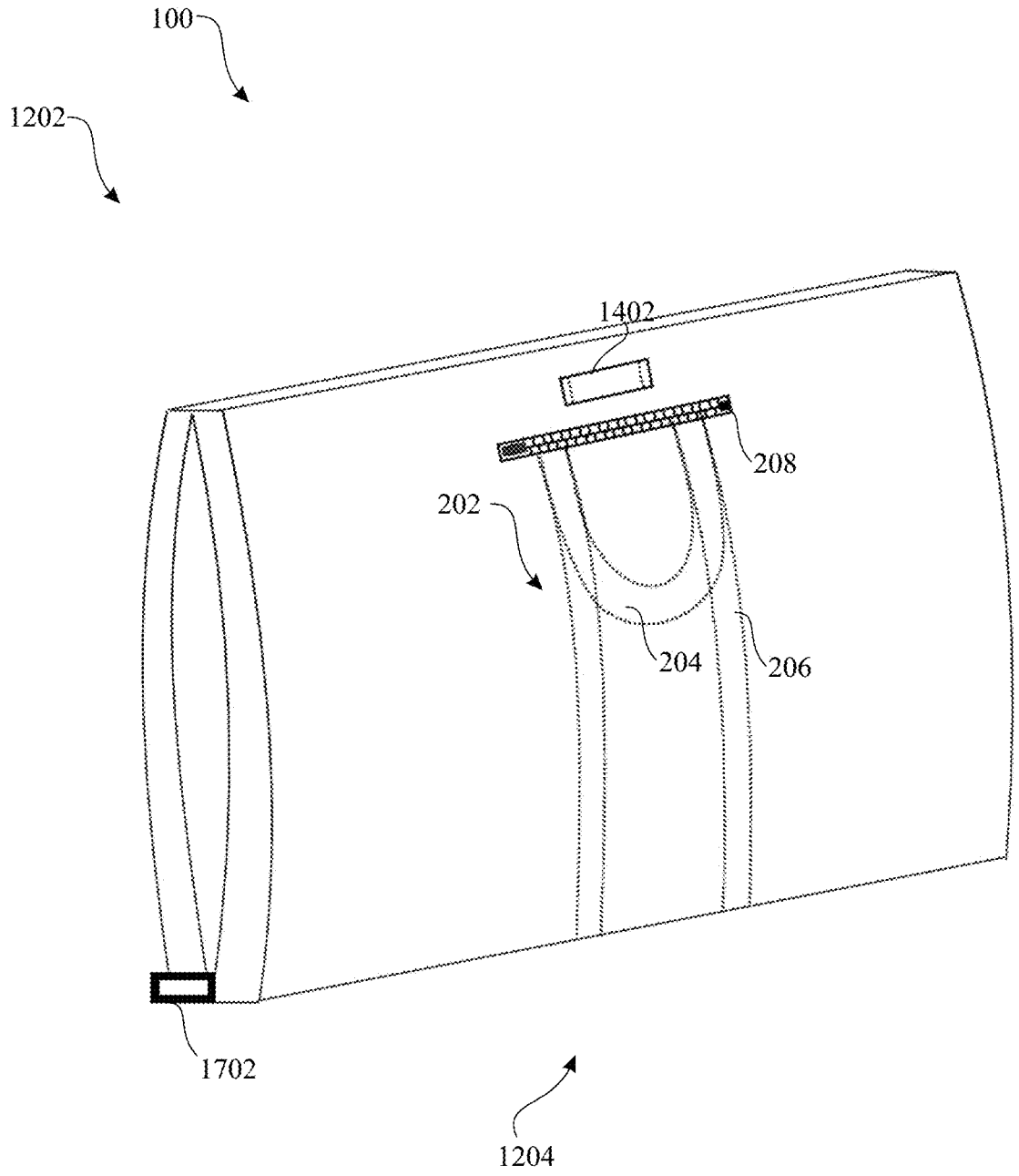
FIG. 12 shows a bag configuration where an inner handle arrangement is shown, where the handles are concealed, in accordance with aspects of the present disclosure.

The article 100 may include a writing instrument holder 902. For example, FIGS. 9-11 show the temporary installation of a pen 904. The writing instrument holder 902 may include a horizontal pocket to receive the writing instrument. In this way the pen is held horizontally for convenient access, to not hinder when the garment is folded. In other words, the axis on which the garment is folded may be parallel to a longitudinal axis of the horizontal pocket of the writing instrument holder 902. The writing instrument holder 902 may be at a front surface 104 of the garment configuration but it is to be understood that the location of the writing instrument holder may be on any appropriate surface of the article 100.

The article 100 may include an eyewear holder 502. For example, FIGS. 5-8 show that the eyewear holder 502 includes two eyewear receivers 504 which may be loops. An upper loop would be positioned above a lower loop, such that the upper loop receives a temple of the eyewear while a lower loop holds a nose bridge portion of the eyewear. The eyewear holder may be located at any appropriate point of the article 100. The eyewear holder 502 may be disposed next to, or attached to, a pocket 506. It is to be understood that any one or both of the receivers may be elastic. The top receiver may be formed by attaching a strip of material (e.g. fabric) at lateral sides of the strip, such that a space between the strip and the garment can receive the temple portion of the eyewear. The bottom receiver may be a loop attached to the garment or the pocket 506.

Figure 14:
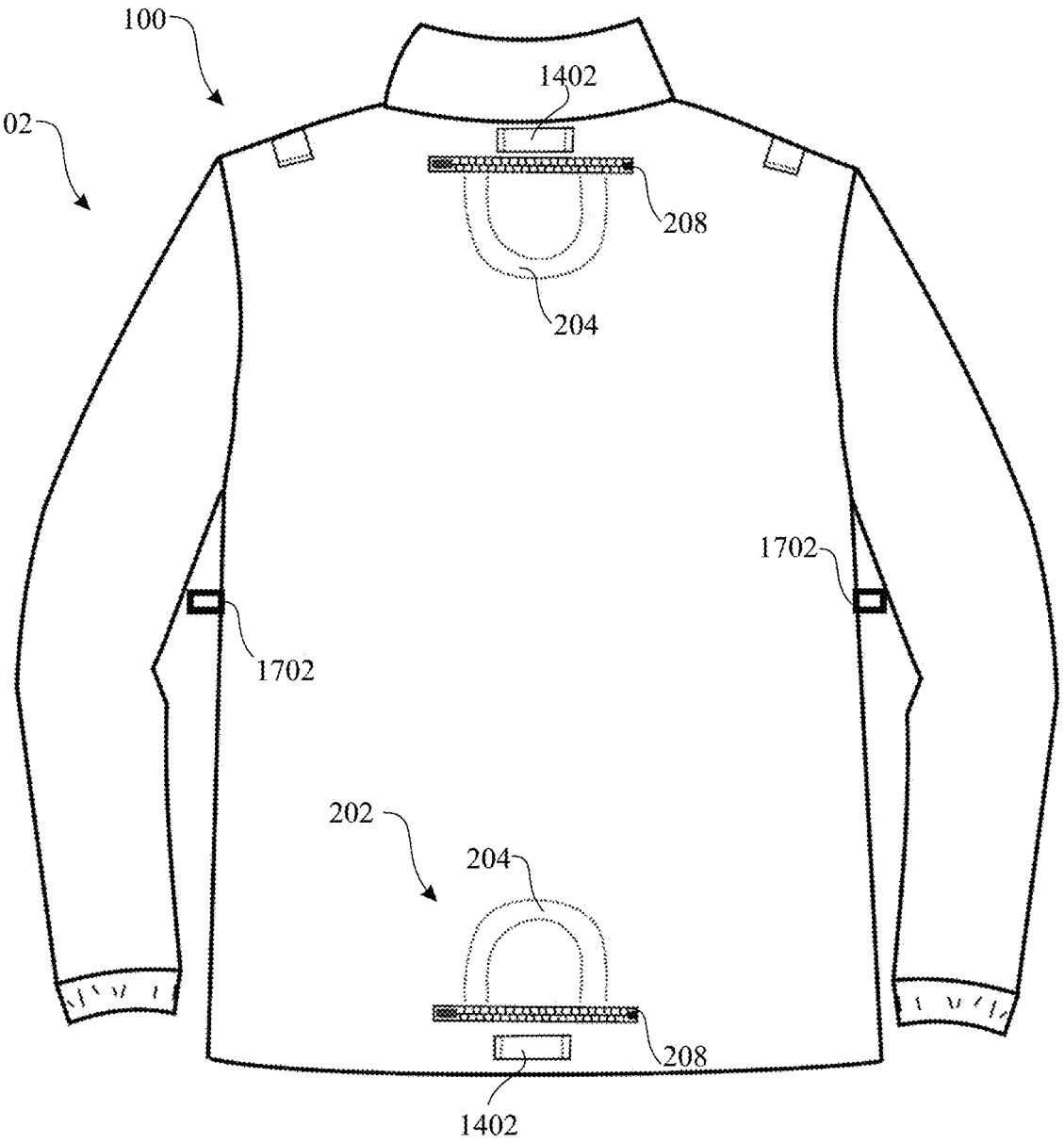
FIG. 14 shows the garment configuration with its straps concealed, without an inner strip, in accordance with aspects of the present disclosure.
Figure 15:
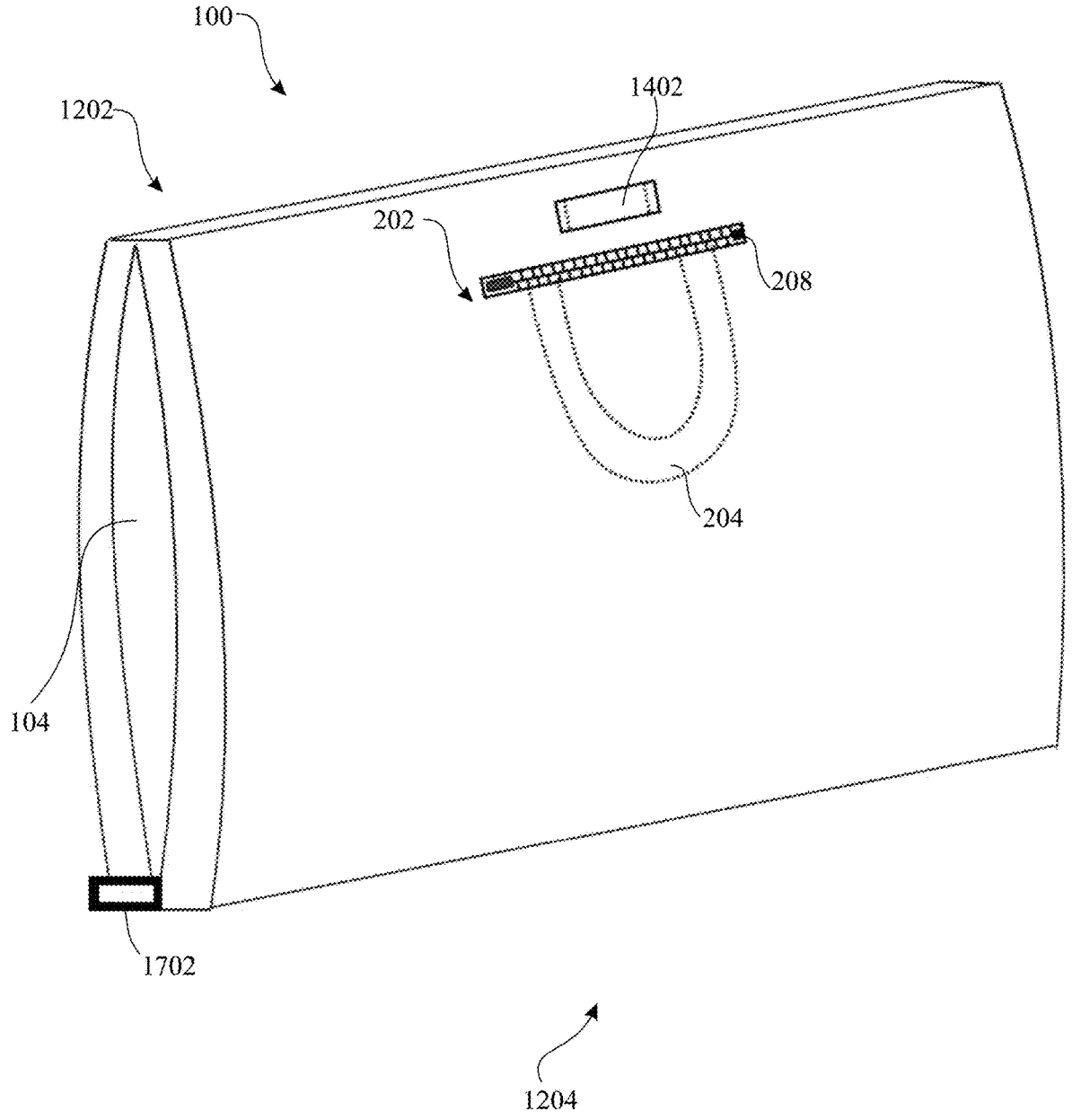
FIG. 15 shows the bag configuration and the concealed handles in dashed line, in accordance with aspects of the present disclosure.
Figure 16:
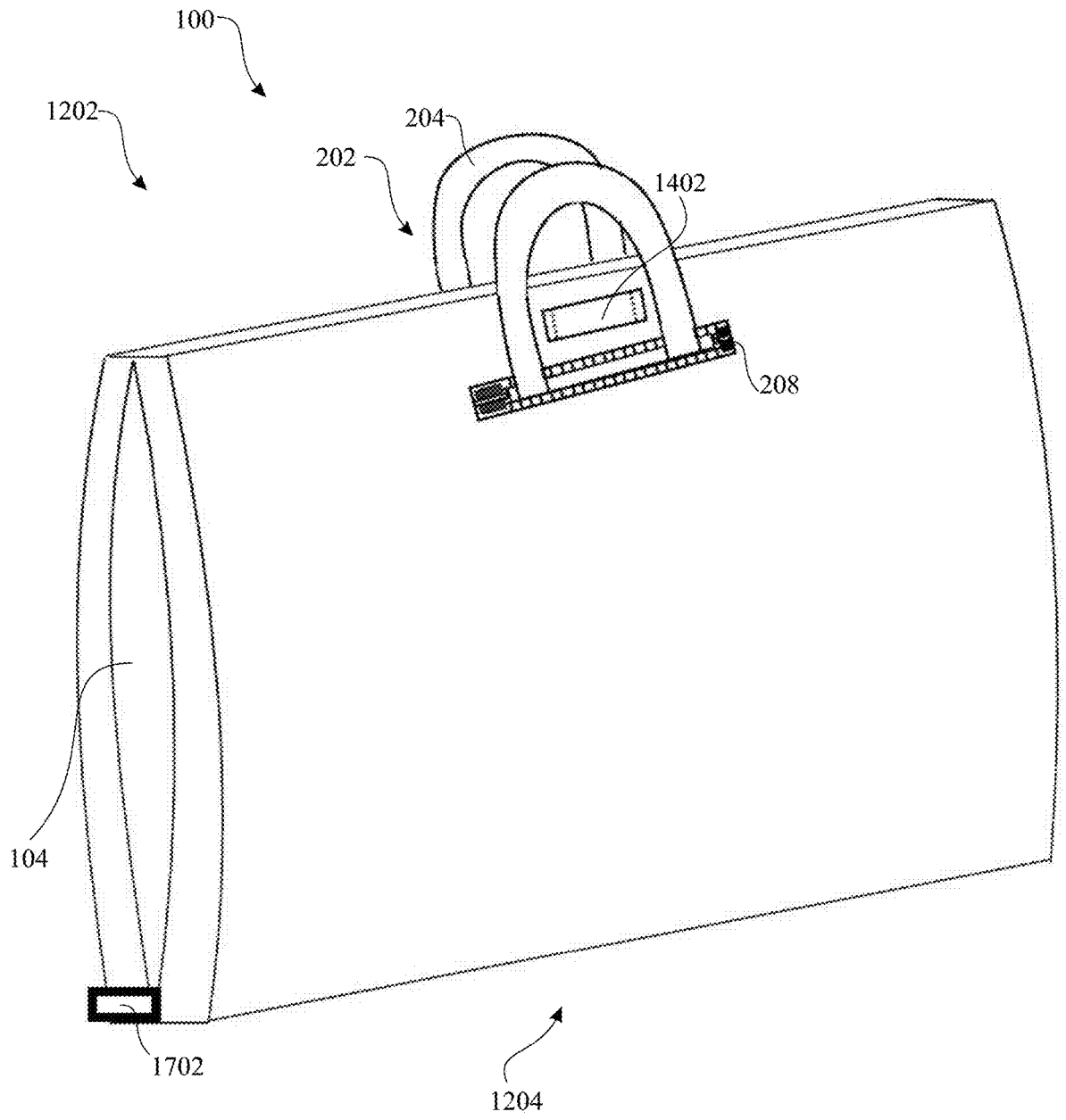
FIG. 16 shows the bag configuration and handles exposed, in accordance with aspects of the present disclosure.
Figure 23:
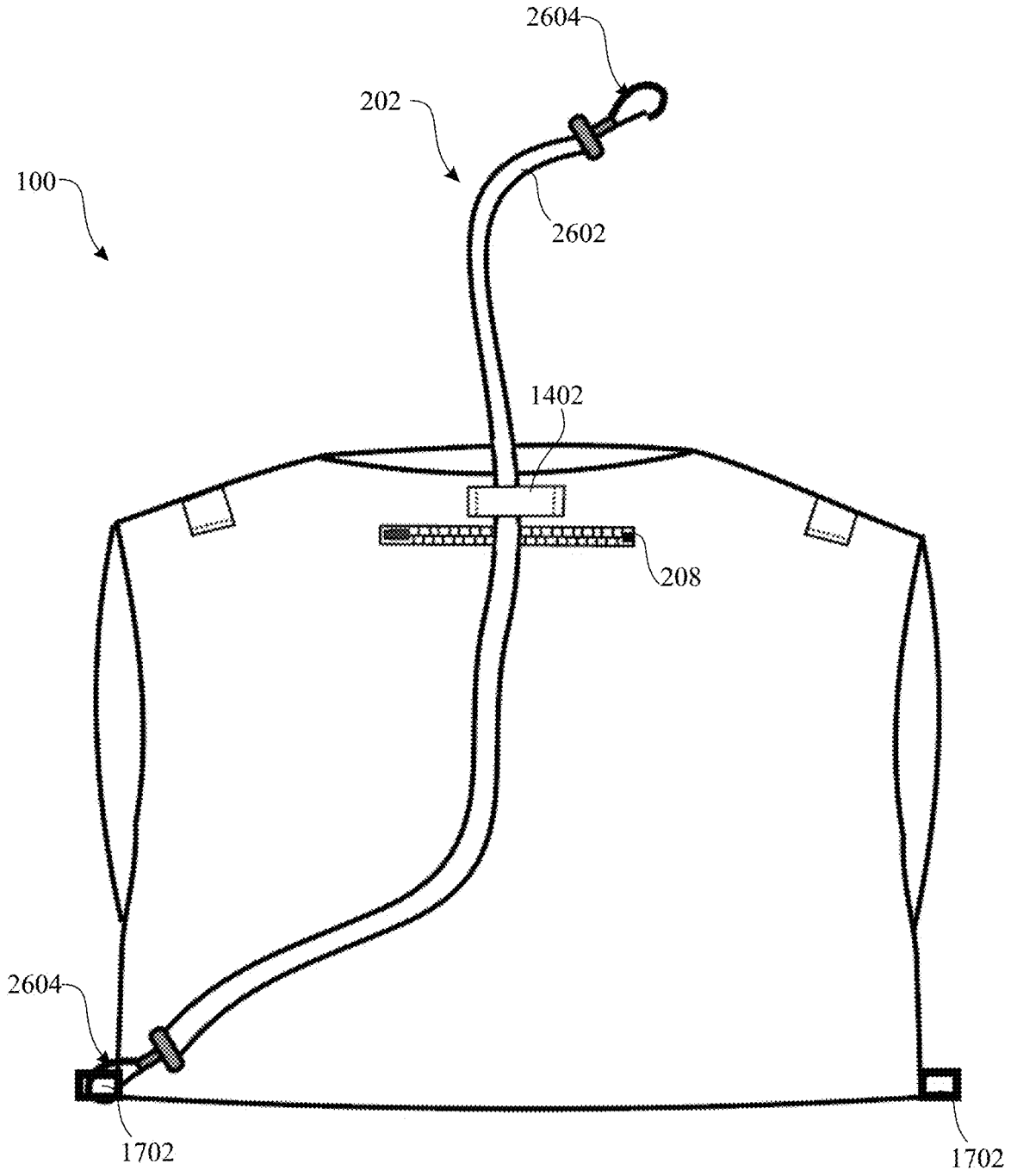
FIG. 23 shows a backpack strap being threaded through an upper loop of the bag configuration, in accordance with aspects of the present disclosure.
Figure 24:
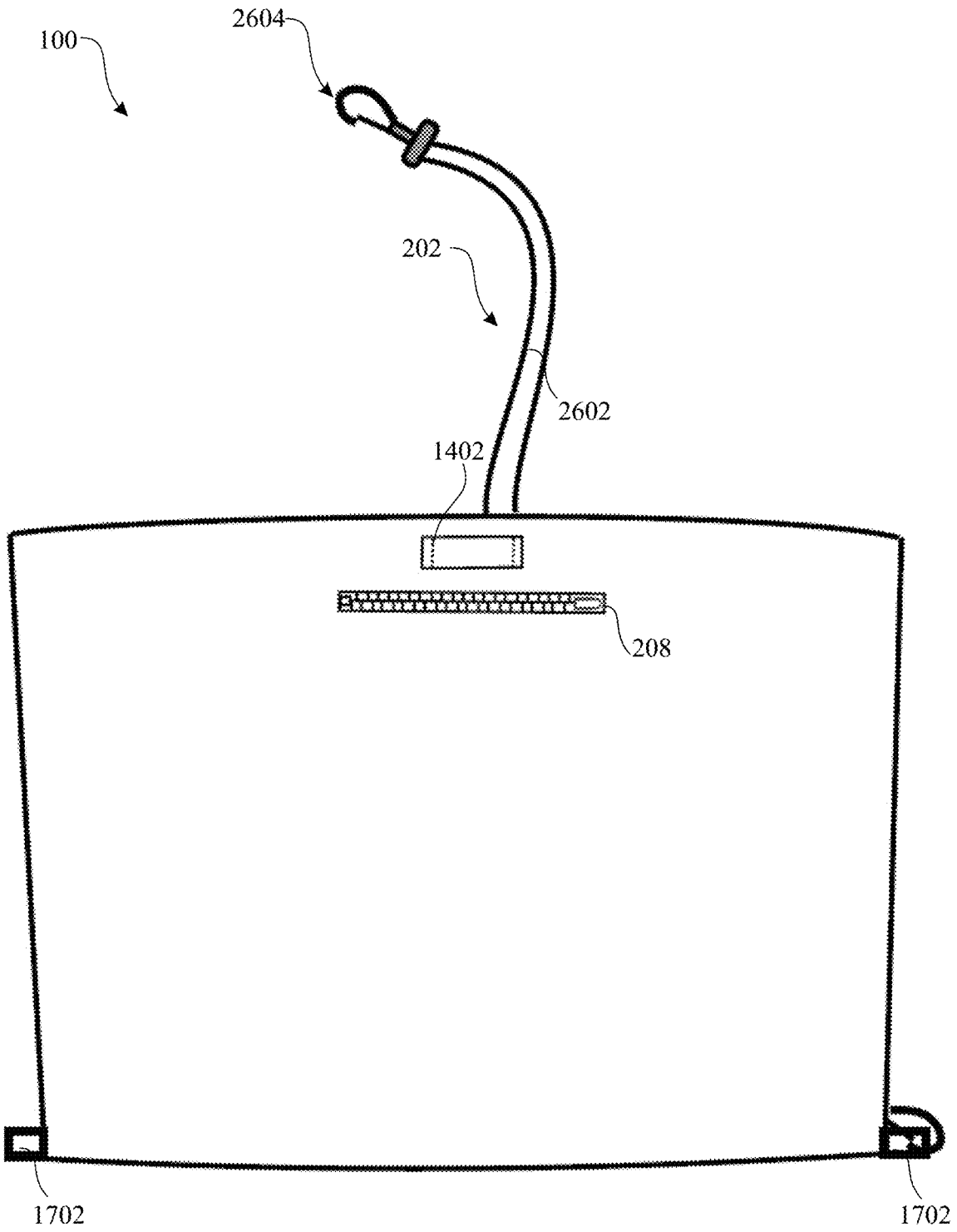
FIG. 24 shows a back view of the same configuration of FIG. 23.
Figure 25:
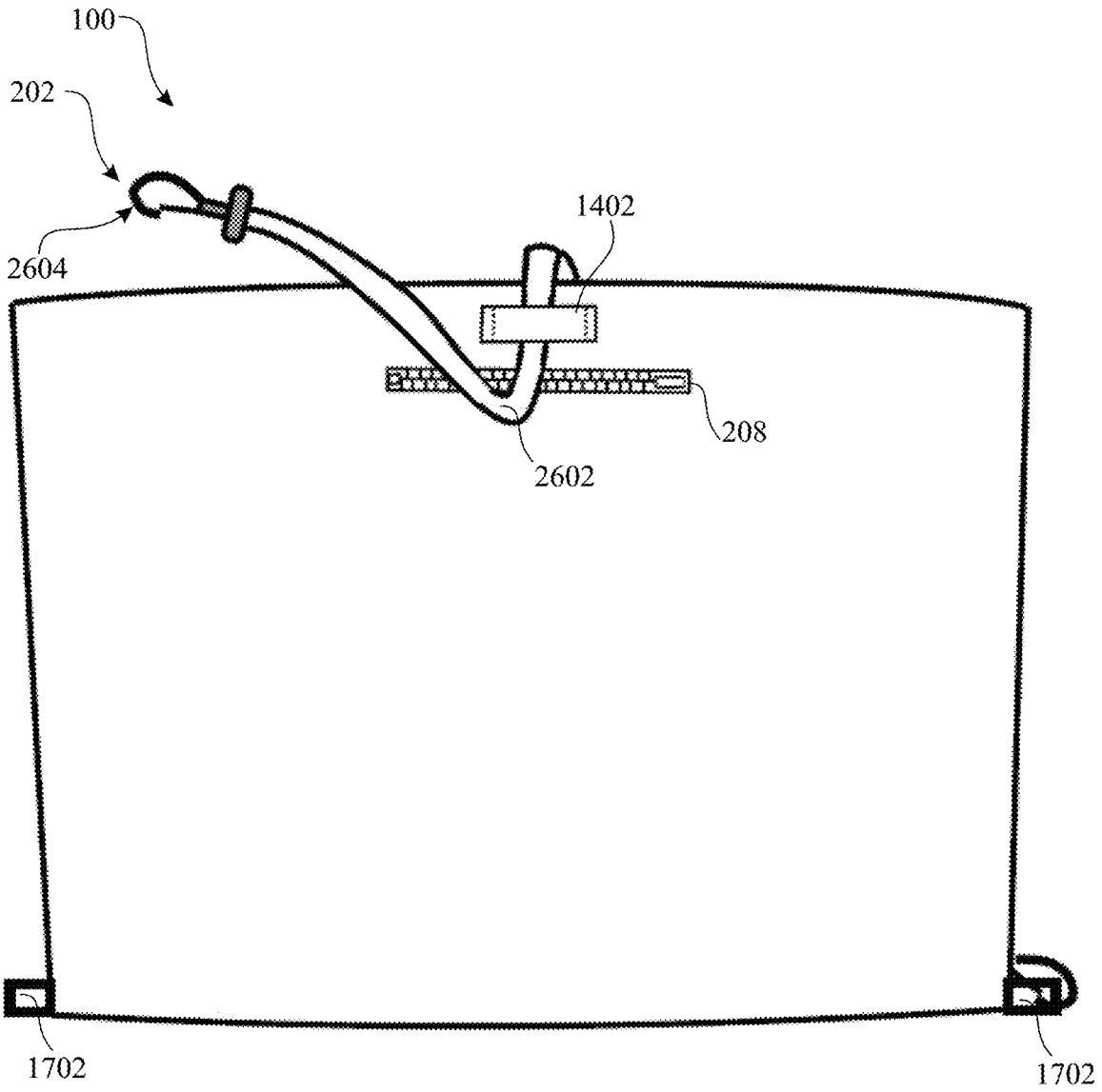
FIG. 25 shows the strap of FIG. 24 being threaded through a loop on an opposite side of the bag configuration, in accordance with aspects of the present disclosure.

In conclusion, the article allows a user to convert or transform a garment 102 (e.g. a jacket) into a bag 1202 and the bag 1202 into the garment 102. As a bag 1202, the article 100 may have handles 204 that are concealable. For example, the handles 204 may be concealable such that the handles 204 are not visible when the article is in a garment form 102 (FIG. 14). One or more loops 1402 may be located on the garment configuration 102 or bag configuration 1202 to allow a strap 2602 to attach to the loops 1402 in the bag configuration 1202 (FIGS. 17, 18, and 23). Depending on where the strap 2602 is attached, or the number of straps 2602 attached, the straps 2602 would allow the bag configuration 1202 to serve as a backpack or handbag. The connectors 2604 at the end of the strap 2602 could be carbiners or the like (e.g. a spring biased clip).

Figure 20:
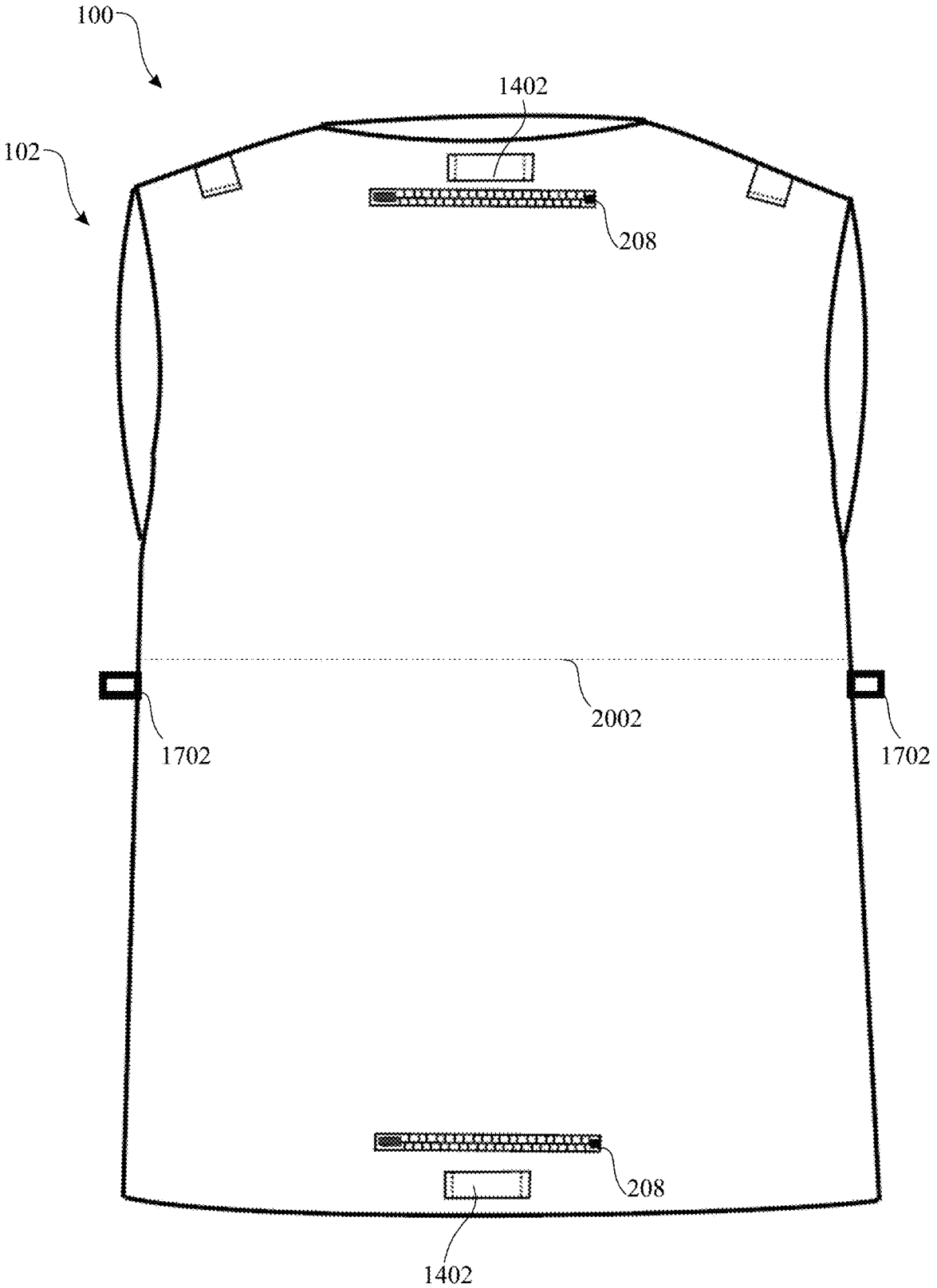
FIG. 20 shows a second step in converting the garment configuration to the bag configuration, where a collar is folded inward, in accordance with aspects of the present disclosure.
Figure 21:
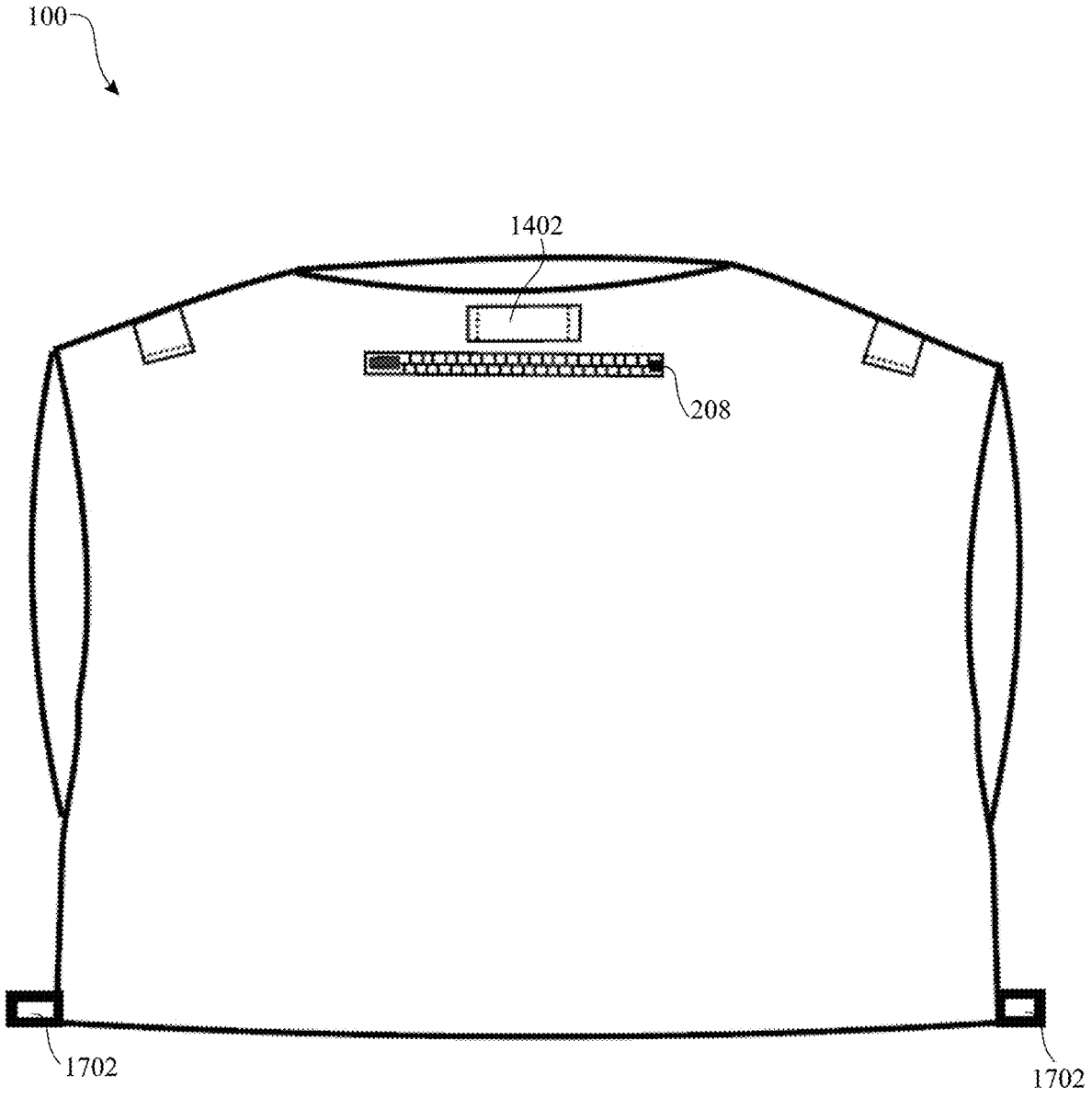
FIG. 21 shows a third step in converting the garment configuration to the bag configuration, where a waist is folded, in accordance with aspects of the present disclosure.
Figure 22:
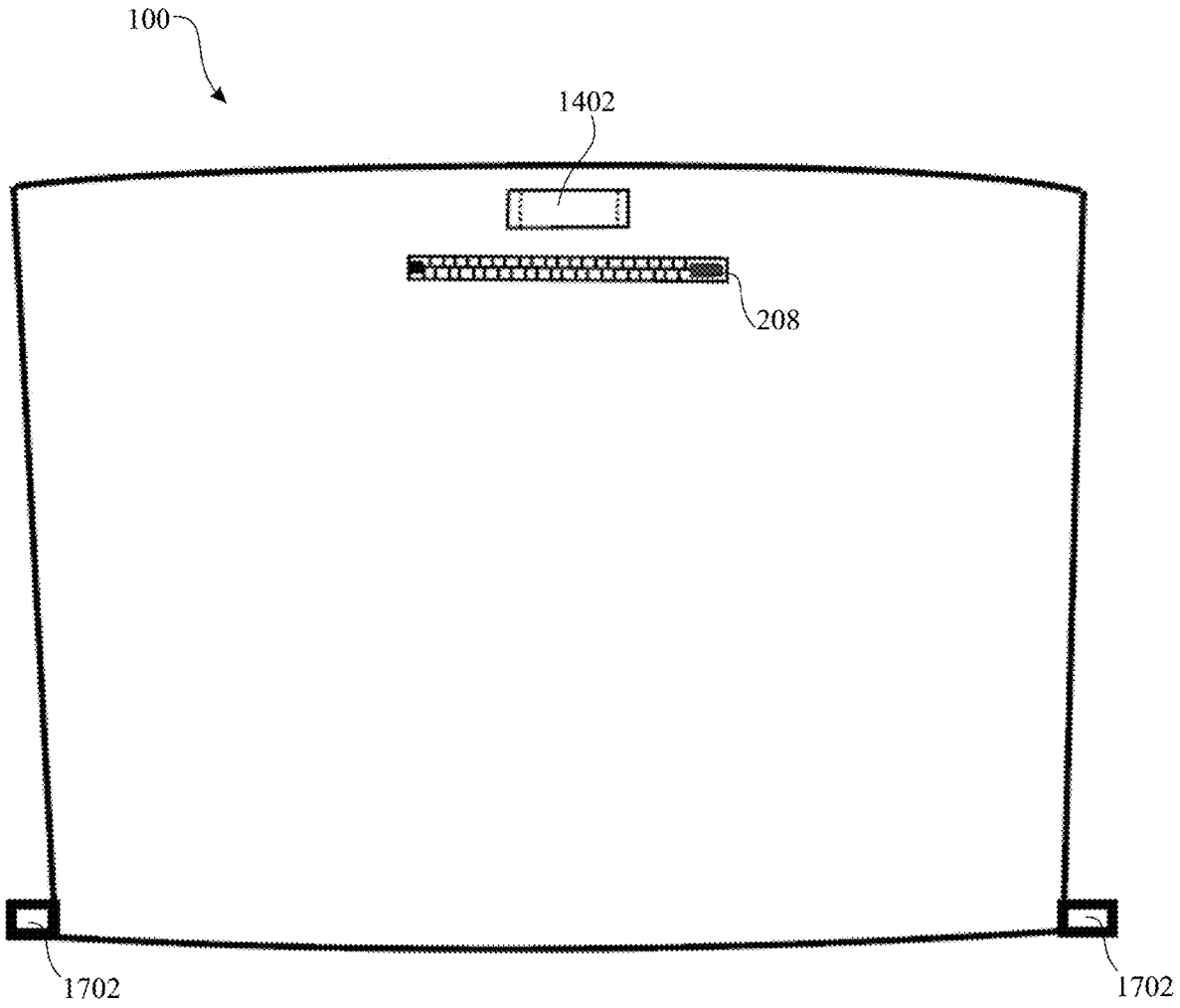
FIG. 22 shows a back view of the bag configuration after the waistline has been folded, in accordance with aspects of the present disclosure.

The garment 102 could fold along its waist 2002 (FIGS. 20 and 21) such that the frontal surface 104 (FIG. 1) of the garment 102 becomes internally located in the bag configuration 1202. This helps keep the pockets 106 internally secure during travels in the bag configuration 1202.

The garment 102 and/or bag 1202 could include an eyewear holder 502 and writing instrument holder 902. For example, such holders may be located on a front surface 104 of the garment configuration 102 such that the holders become internally located in the bag configuration.

It is to be understood that the fasteners shown in the figures and mentioned herein may be any appropriate fastener such as zippers or even in some instances buttons or hook and loop fasteners.

The handles 204 may be through-design, which means they could include a sub-surface strip 206 attaching opposing handles 204 together. This configuration adds significant strength to the bag configuration 1202, because in the bag configuration 1202, the strip 206 structure extends from handle-to-handle and, under tension, it helps support contained items. However it is to be understood that such sub-surface strips 206 may be omitted, and in some instances they may be visible to the naked eye rather than being hidden behind a surface of the article. A strip could be one wide piece of strong and flexible material, or a plurality of strands or discontinuous portions.

Figure 4:
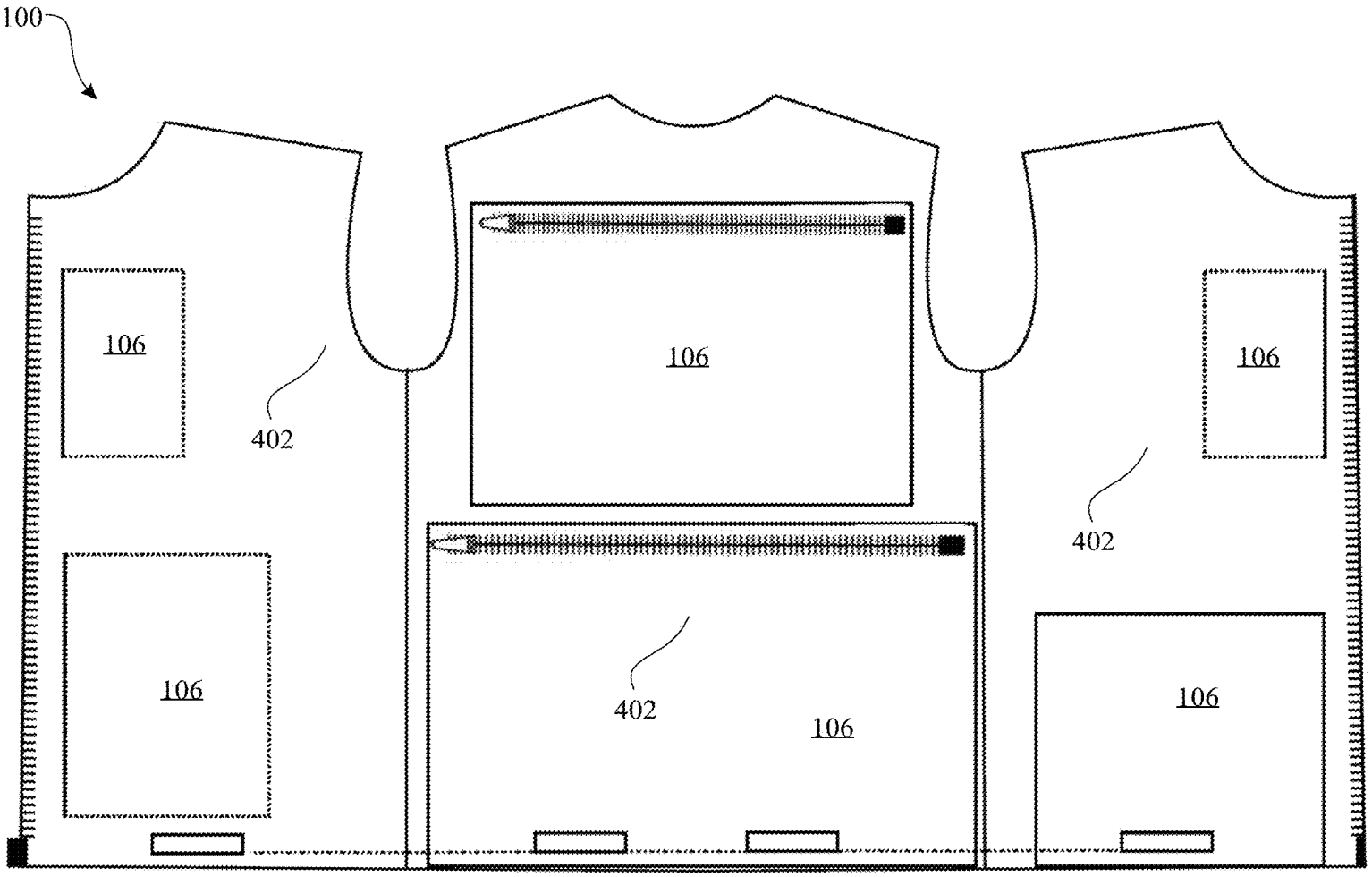
FIG. 4 presents the article in an open configuration, where inner pockets and features are exposed, in accordance with aspects of the present disclosure.
Figure 5:
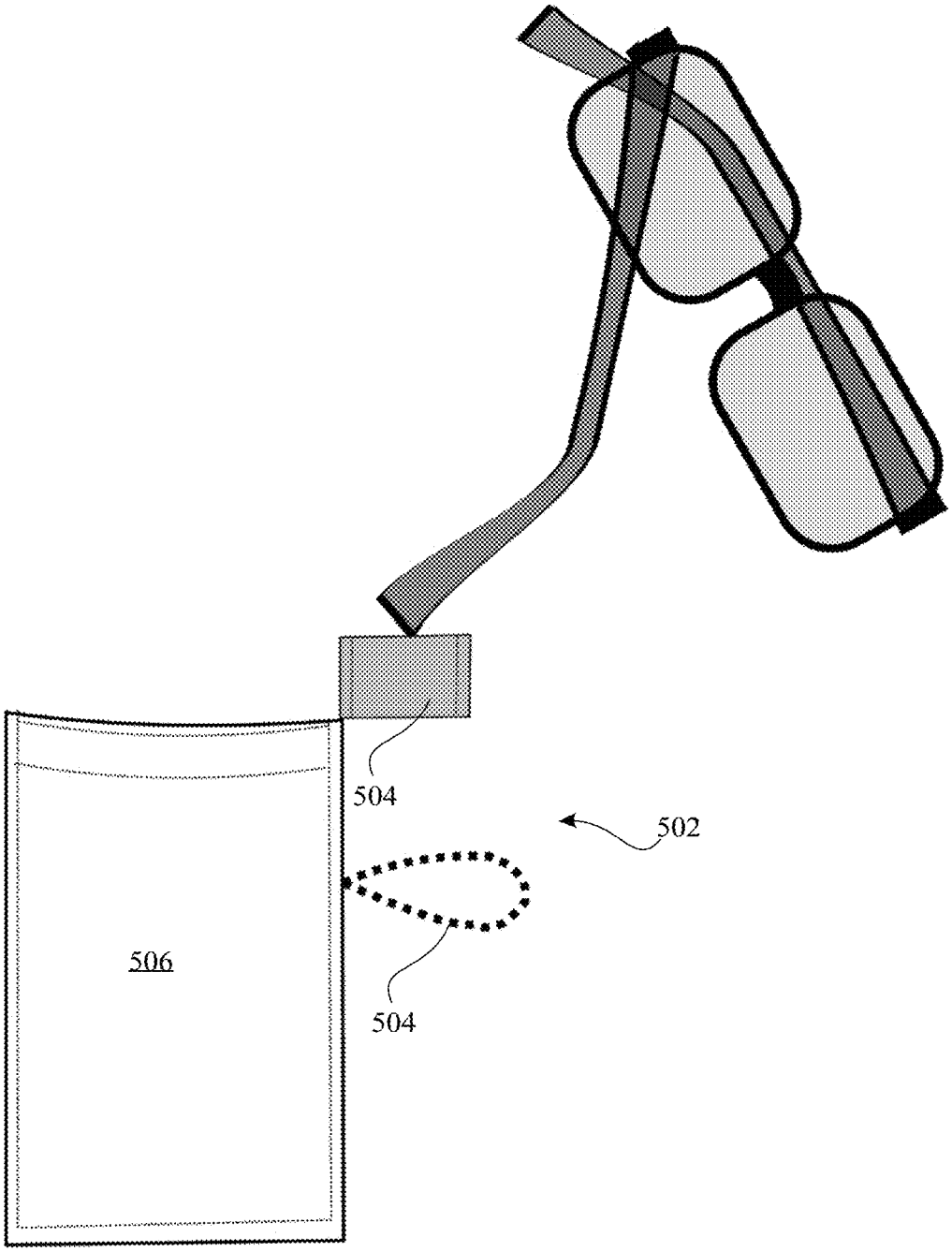
FIGS. 5-7 show a front view of an eyewear holder and its sequence of use, in accordance with aspects of the present disclosure.
Figure 6:
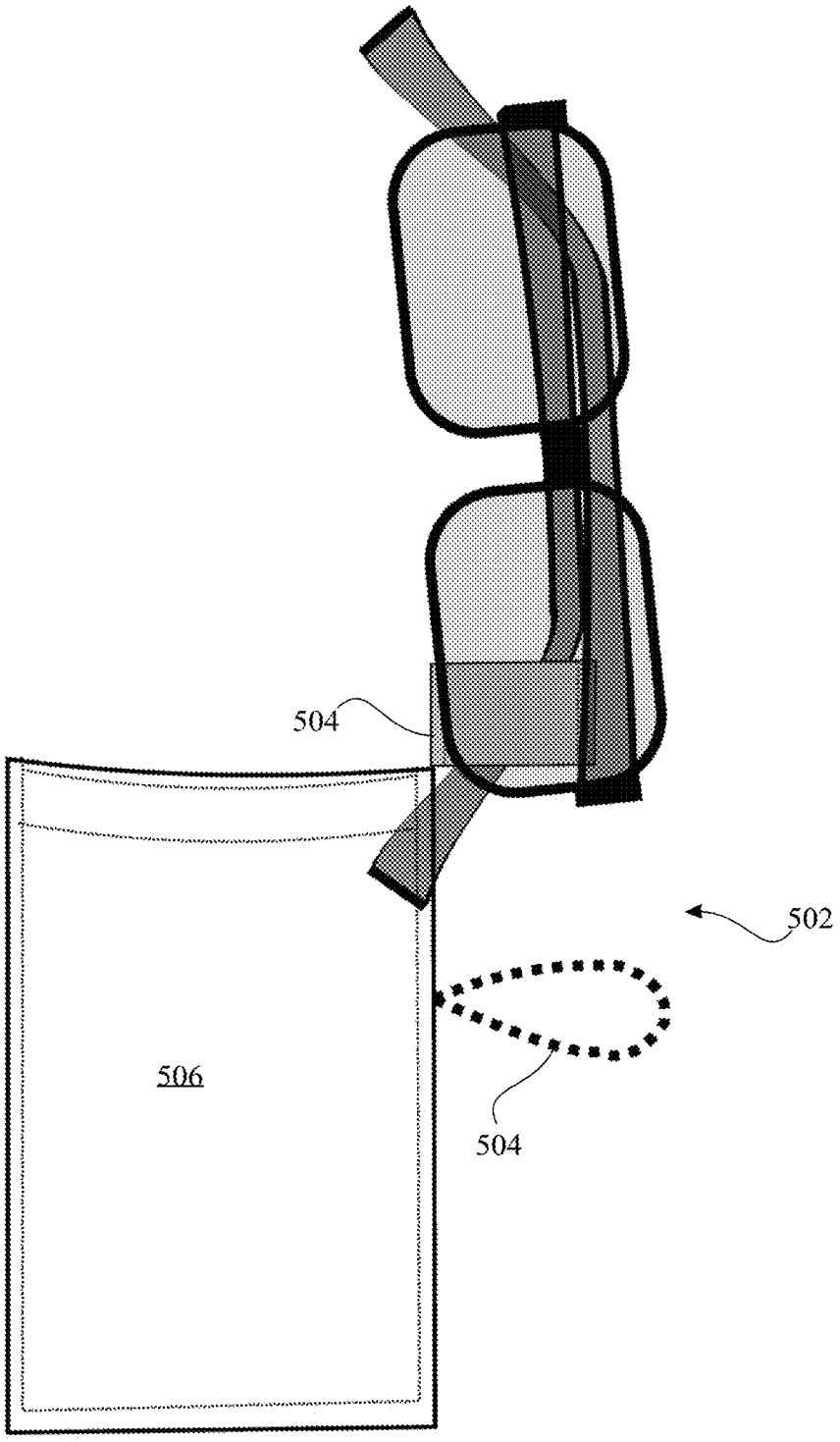
Figure 7:
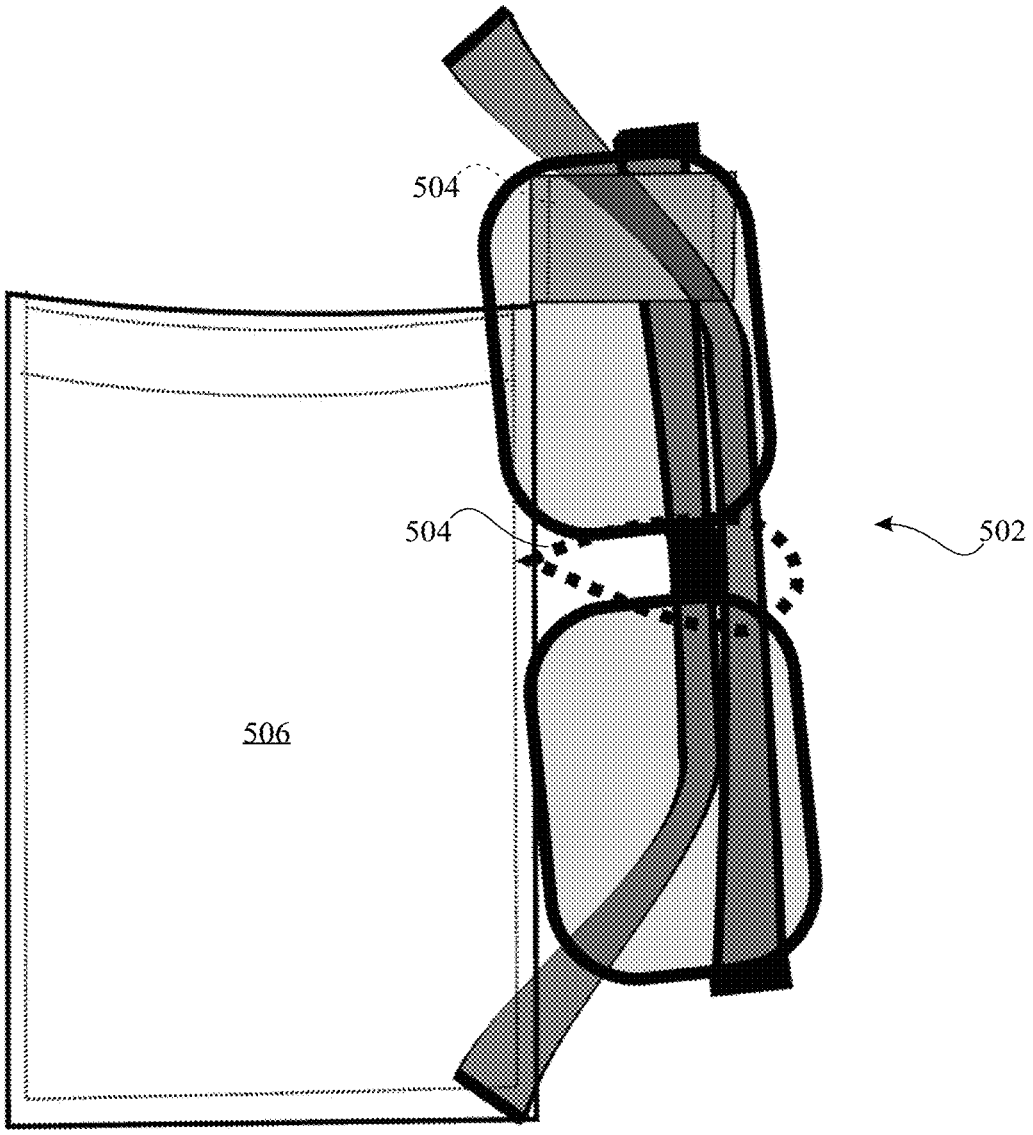
Figure 8:
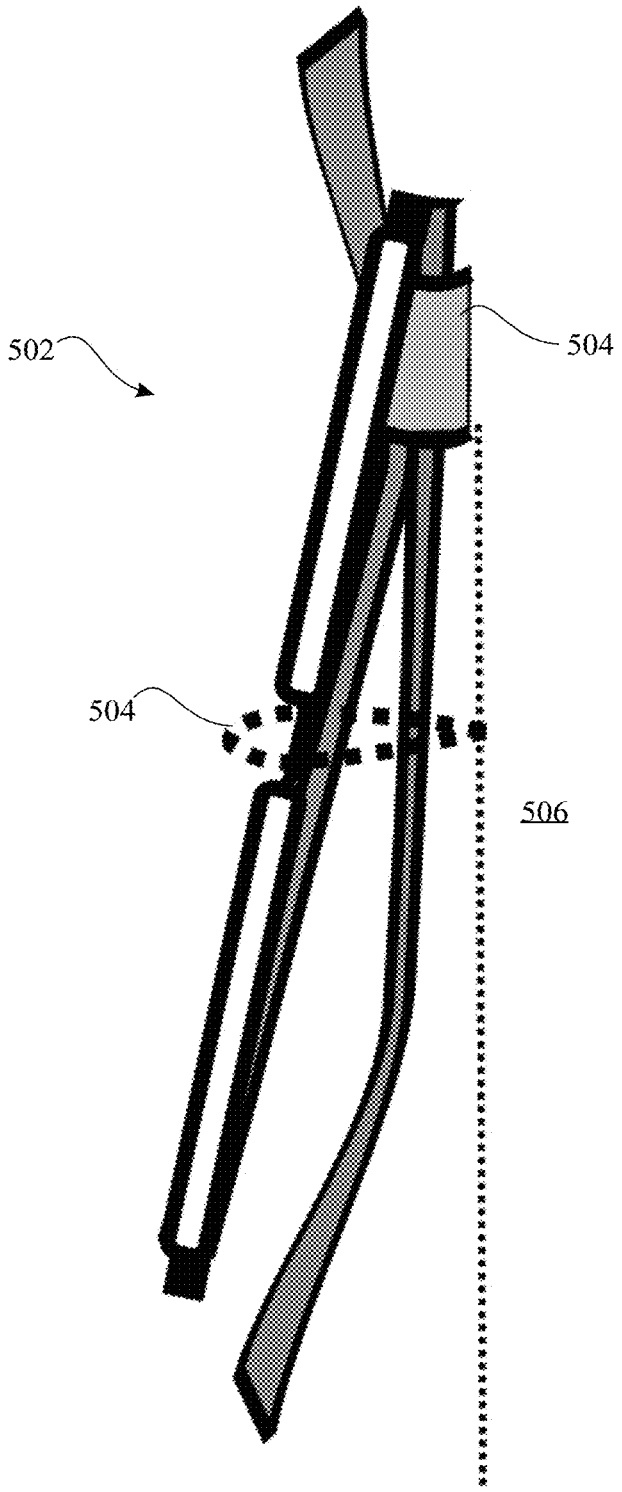
FIG. 8 shows a side view of the eyewear holder, in accordance with aspects of the present disclosure.

As shown in FIG. 4, there may be any number of pockets inside the garment 102 as well as on an outside surface of the garment 102. For example, as shown in FIG. 4, a pocket 106 may be located on and accessed from an inside surface 402 of the garment at a back of the garment (e.g. this pocket would rest directly in contact against a user's back when the garment is worn).

The garment may be folded in any appropriate way. For example, it may be folded along a vertical or horizontal axis. Once folded, open areas of the once-garment would be sealed to form a cavity of the bag. For example, zippers or buttons could be included appropriately to selectively seal or open any portion that needs to be closed to form a bag or a garment. Although it is useful to keep the pockets inwardly facing in the bag configuration, the garment could alternatively be folded such that the pockets face outward. In other words, either one of the front or back surfaces of the garment could become an internally facing or externally facing surface of the bag depending on a folding direction. The folding direction could be about an axis at the waist or even a vertical axis. Such a vertical axis is to be understood as being roughly the intersection of the sagittal plane with the body with reference to direct frontal view of the garment. This is not to be limiting, and is mentioned merely to advance the illustration.

As a robe, the garment could have buttons down the lateral sides of the robe such that the buttons may be attached to one another in the bag configuration to close the cavity of the bag configuration.

In some examples, the handles could be attached within their respective concealable areas without the sub-strip being present which could reduce manufacturing costs.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A wearable article that is physically and selectively convertible between a garment configuration and a bag configuration, the article comprising:

in adopting either of a selected one of the garment configuration or the bag configuration, a carrying arrangement in the form of a concealable handle, for carrying the wearable article selectively adopting either of the garment configuration or the bag configuration;

wherein the wearable article includes at least one of a pair of sleeves and a collar in a garment configuration and wherein the at least one pair of sleeves and a collar are concealed in a bag configuration;

wherein the carrying arrangement includes two handles that are oppositely located such that when the article is folded along a waist line into the bag configuration, the handles meet such that the handles are usable to carry the bag configuration;

wherein the handles are each located at end portions of an inner strip, the inner strip passing through an underside portion of the article in the bag configuration to add strength to the bag configuration;

wherein the handles are each concealable in a pocket in a rear surface of the garment configuration, each pocket having a closable opening on an outer rear surface of the garment configuration, and each closable opening is also on an exterior of the bag configuration;

the handles being connected directly to one another via the inner strip;

wherein the inner strip is a sub-surface strip such that the inner strip runs through a surface of the article; and the handles having a through-design such that they include the sub-surface strip attaching opposing handles together, configured such that the sub-surface strip adds strength to lower areas of the bag configuration due to the bag configuration having the sub-surface strip extend from handle-to-handle and, under tension, having been configured to support to the contained items.

2. The wearable article of claim 1, wherein the handles are selectively concealable behind the pocket, and exposable through the pocket for use.

3. The wearable article of claim 1 wherein, the carrying arrangement includes two attachment points on the garment configuration, such that the attachment points are each connected to opposite ends of a strap, allowing the bag configuration to be carried by the strap; and wherein attachment points are defined as structures configured to selectively receive a fastener on the strap.

4. The wearable article of claim 3, wherein the attachment points are positioned at a waist of the garment configuration, such that the strap is attachable to the attachment points while being threaded through a loop on the wearable article, allowing the bag configuration to be carried as a backpack.

5. The wearable article of claim 3, wherein the strap is threaded through both handles while being attached to the attachment points at the waist, allowing the bag configuration to be used as a backpack.

6. The wearable article of claim 3, wherein the attachment points are on shoulders of the garment configuration such that when the strap is attached to the shoulders, the bag configuration is carriable as a handbag.

7. The wearable article of claim 1, wherein the article includes a writing instrument holder, the writing instrument holder having a horizontal pocket for snugly receiving a writing instrument.

8. The wearable article of claim 1, wherein the article includes an eyewear holder, the eyewear holder including an upper loop for receiving a temple of an eyewear piece, and a lower loop for receiving a bridge of the eyewear piece.

9. The wearable article of claim 1, wherein in the garment configuration, the article is in the form of a robe.

10. A wearable article that is physically and selectively convertible between a garment configuration and a bag configuration, the article comprising:

in adopting either of a selected one of the garment configuration or the bag configuration, a carrying arrangement in the form of a concealable handle, for carrying the wearable article selectively adopting either of the garment configuration or the bag configuration;

wherein the wearable article includes at least one of a pair of sleeves and a collar in a garment configuration and wherein the at least one pair of sleeves and a collar are concealed in a bag configuration;

wherein the carrying arrangement includes two handles that are oppositely located such that when the article is folded along a waist line into the bag configuration, the handles meet such that the handles are usable to carry the bag configuration;

wherein the handles are each located at end portions of an inner strip, the inner strip passing through an underside portion of the article in the bag configuration to add strength to the bag configuration;

wherein the handles are each concealable in a pocket in the rear surface of the garment configuration, each pocket having a closable opening on an outer rear surface of the garment configuration, and each closable opening is also on the exterior of the bag configuration;

the handles being connected directly to one another via the inner strip;

wherein the inner strip is a sub-surface strip such that the inner strip runs through a surface of the article; and the handles having a through-design such that they include the sub-surface strip attaching opposing handles together, configured such that the sub-surface strip adds strength to lower areas of the bag configuration due to the bag configuration having the sub-surface strip extend from handle-to-handle and, under tension, having been configured to support the contained items.

11. The wearable article of claim 10, wherein the handles are selectively concealable behind the pocket, and exposable through the pocket for use.

12. The wearable article of claim 10 wherein, the carrying arrangement includes two attachment points on the garment configuration, such that the attachment points are each connected to opposite ends of a strap, allowing the bag configuration to be carried by the strap and wherein attachment points are defined as structures configured to selectively receive a fastener on the strap.

13. The wearable article of claim 12, wherein the attachment points are positioned at a waist of the garment configuration, such that the strap is attachable to the attachment points while being threaded through a loop on the wearable article, allowing the bag configuration to be carried as a backpack.

14. The wearable article of claim 12, wherein the strap is threaded through both handles while being attached to the attachment points at the waist, allowing the bag configuration to be used as a backpack.

15. The wearable article of claim 12, wherein the attachment points are on shoulders of the garment configuration such that when the strap is attached to the shoulders, the bag configuration is carriable as a handbag.

16. The wearable article of claim 10, wherein the article includes a writing instrument holder, the writing instrument holder having a horizontal pocket for snugly receiving a writing instrument.

17. The wearable article of claim 10, wherein the article includes an eyewear holder, the eyewear holder including an upper loop for receiving a temple of an eyewear piece, and a lower loop for receiving a bridge of the eyewear piece.

18. A wearable article that is physically and selectively convertible between a garment configuration and a bag configuration, the article comprising:

in adopting either of a selected one of the garment configuration or the bag configuration, a carrying arrangement in the form of a concealable handle, for carrying the wearable article selectively adopting either of the garment configuration or the bag configuration;

wherein the wearable article includes at least one of a pair of sleeves and a collar in a garment configuration and wherein the at least one pair of sleeves and a collar are concealed in a bag configuration;

wherein the carrying arrangement includes two handles that are oppositely located such that when the article is folded along a waist line into the bag configuration, the handles meet such that the handles are usable to carry the bag configuration;

wherein the handles are each located at end portions of an inner strip, the inner strip passing through an underside portion of the article in the bag configuration to add strength to the bag configuration;

wherein the handles are each concealable in a pocket in the rear surface of the garment configuration, each pocket having a closable opening on an outer rear surface of the garment configuration, and each closable opening is also on the exterior of the bag configuration;

the handles being connected directly to one another via the inner strip;

wherein the inner strip is a sub-surface strip such that the inner strip runs through a surface of the article; and the handles having a through-design such that they include the sub-surface strip attaching opposing handles together, configured such that the sub-surface strip adds strength to lower areas of the bag configuration due to the bag configuration having the sub-surface strip extend from handle-to-handle and, under tension, having been configured to support the contained items.

* * * * *